US007553173B2

(12) United States Patent
Kowalick

(10) Patent No.: US 7,553,173 B2
(45) Date of Patent: Jun. 30, 2009

(54) VEHICLE CONNECTOR LOCKOUT APPARATUS AND METHOD OF USING SAME

(75) Inventor: Thomas M. Kowalick, Southern Pines, NC (US)

(73) Assignee: Click, Inc., Southern Pines, NC (US)

( * ) Notice: Subject to any disclaimer, the term of this patent is extended or adjusted under 35 U.S.C. 154(b) by 0 days.

(21) Appl. No.: 11/968,645

(22) Filed: Jan. 2, 2008

(65) Prior Publication Data

US 2008/0214022 A1 Sep. 4, 2008

Related U.S. Application Data

(63) Continuation-in-part of application No. 11/618,550, filed on Dec. 29, 2006, now abandoned.

(60) Provisional application No. 60/754,899, filed on Dec. 30, 2005.

(51) Int. Cl.
*H01R 13/44* (2006.01)

(52) U.S. Cl. ..... 439/133

(58) Field of Classification Search ..... 439/133, 439/134, 304, 680

See application file for complete search history.

(56) References Cited

U.S. PATENT DOCUMENTS 4,584,856 A * 4/1986 Petersdorff et al. ..... 70/57
5,055,057 A * 10/1991 Boyer ..... 439/134
5,190,465 A * 3/1993 Davidge et al. ..... 439/304
5,190,466 A * 3/1993 McVey ..... 439/304
5,220,815 A * 6/1993 Davidge et al. ..... 70/14
5,678,868 A * 10/1997 Williams et al. ..... 292/144
5,745,045 A * 4/1998 Kulha et al. ..... 340/5.2
6,508,654 B1 * 1/2003 Tatz ..... 439/134
6,588,243 B1 * 7/2003 Hyatt et al. ..... 70/278.2
6,997,724 B2 * 2/2006 Earl ..... 439/133
2003/0205071 A1 * 11/2003 Hyatt, Jr. ..... 70/283
2004/0246098 A1 * 12/2004 Denison et al. ..... 340/5.73

* cited by examiner

*Primary Examiner*—Neil Abrams
*Assistant Examiner*—Harshad C Patel
(74) *Attorney, Agent, or Firm*—Whitham Curtis Christofferson & Cook, P.C.

(57) ABSTRACT

According to the present invention, a vehicle connector lockout apparatus capable of being connected to the diagnostic port of a vehicle is provided. The preferred embodiment of the invention uses a raised protrusion, located in the common space below the two rows of pin spacing of the diagnostic port, as a locking point. The preferred embodiment provides a blocking mating connector with a pressure mechanism for clamping the mating connector to the protrusion. In the preferred embodiment the pressure mechanism is activated and released mechanically by operation of a key in a key lock which is an integral part of the mating connector, where rotation of the key to the locked position in the key lock applies pressure to the protrusion so as to clamp the blocking mating connector to the protrusion. A further embodiment of the invention provides a non-volatile microchip memory component to store information about the vehicle operator usable by medical personnel at the scene of a crash.

20 Claims, 18 Drawing Sheets

VEHICLE CONNECTOR LOCKOUT APPARATUS AND METHOD OF USING SAME

This application is a continuation in part from U.S. patent application Ser. No. 11/618,550 of the same title, which is incorporated herein by reference, and which was filed on Dec. 29, 2006 now abandoned claiming priority from now-expired U.S. Provisional Patent Application 60/754,899 of the same title filed on Dec. 30, 2005.

BACKGROUND OF THE INVENTION

1. Field of the Invention

The present invention relates to motor vehicle connector lockout devices, and in particular to lockout devices for vehicle diagnostic data link connectors.

2. Background Description

The past four decades have witnessed an exponential increase in the number and sophistication of electronic systems in vehicles. A vast increase in automotive electronic systems, coupled with related memory storage technologies, has created an array of new safety engineering opportunities and subsequent consumer acceptance challenges.

Virtually every passenger car and light truck manufactured in or imported to the North American market since model year 1996 includes an Environmental Protection Agency (EPA) mandated diagnostic link connector to allow access to engine and emissions diagnostic data. This onboard diagnostic link connector (OBDII) is regulated by the Code of Federal Regulations (CFR) (40 CFR 86.094-17(h) and revisions for subsequent model years. It is standardized by the Society of Automotive Engineers (SAE) Vehicle Electrical Engineering Systems Diagnostic Standards Committee. The physical configuration of the output plug is specified under SAE J1962 and through the International Standards Organization under ISO 15031-3 and is increasingly used as an access point to other in-vehicle electronics systems, sub-systems, computers, sensors, actuators and an array of control modules including the air bag control module. The onboard diagnostic link connector is also used as a serial port to retrieve data elements from on-board systems, sub-systems, modules, devices and functions that collect and store data elements related to a vehicle crash such as a Restraint Control Module (RCM) and Event Data Recorder (EDR).

Thus, the onboard diagnostic link connector provides a portal for capture of an increasing volume of sophisticated sensor data regarding the operating condition, operation and behavior of vehicles, and in particular the operation and behavior of vehicles involved in crashes. Consumers continue to be interested in safety advancements but remain concerned about issues of privacy, tampering and misuse of vehicle crash data.

The EPA communications protocol utilizes a Controller Area Network (CAN) to provide a standardized interface between the diagnostic link connector and the tools used by service technicians and vehicle emission stations. CAN uses a serial bus for networking computer modules as well as sensors. The standardized interface allows technicians to use a single communications protocol to download data to pinpoint problems and potential problems related to vehicle emissions. Full implementation of the CAN protocol is required by 2008. Because it is a universal system, the use of the diagnostic link connector and the CAN serial bus alleviates the problem that the data would only be accessible through the use of multiple interfaces and different kinds of software, if at all.

While standardizing the means and protocols for data extraction is generally considered a positive advancement in surface transportation by helping to assure that systems perform properly over the useful life of vehicles, it has also created the possibility of extracting data from motor vehicles that can be used in civil and criminal legal proceedings. For example, the National Highway Traffic Safety Administration (NHTSA) cites an Event Data Recorder (EDR) as a device or function voluntarily installed in a motor vehicle that records a vehicle's dynamic, times series data and/or technical vehicle and occupant information for a brief period of time (seconds, not minutes) before, during and after a crash. EDRs collect vehicle crash information intended for retrieval after the crash. These devices are common in many vehicles. The USDOT/NHTSA estimates that about 9.8 million (64 percent) of the 15.5 million new light vehicles with a gross vehicle weight rate (GVWR) less than or equal to 3.855 kg (8,500 pounds) are already equipped with electronic control systems, which, in one form or another, are equivalent to an EDR. The following table lists vehicle manufacturers, their share of the market, the estimated portion of each manufacturer's production that is equipped with EDRs, and the weighted market share of EDRs. As noted in the table, data for passenger cars and light truck sales were derived from two separate sources: the 2004 Wards Automotive Book for passenger cars and the Mid-Term Mid-Model Year Fuel Economic Report Data for light trucks with GVWR less than or equal to 3,855 kg (8,500 pounds).

Estimate of the Number EDRs in Light Vehicles with A GVWR of 3,855 Kilograms (8,500 Pounds) or Less

| Line | Sales* | Percent of Sales | % With EDRs** | # of EDRs |
|---|---|---|---|---|
| BMW | 279,706 | 1.7% | 0% | 0 |
| Daewoo[1] | 37,851 | 0.2% | 0% | 0 |
| DaimlerChrysler | 1,997,346 | 12.8% | 21% | 419,443 |
| Ford | 3,125,780 | 20.6% | 100% | 3,125,780 |
| GM | 4,407,110 | 28.3% | 100% | 4,407,110 |
| Honda | 1,380,153 | 8.1% | 0% | 0 |
| Hyundai | 397,458 | 2.4% | 0% | 0 |
| Isuzu | 75,440 | 0.2% | 100% | 75,440 |
| Kia | 234,792 | 1.4% | 0% | 0 |
| Mazda | 163,694 | 1.6% | 100% | 163,694 |
| Mercedes | 186,553 | 1.3% | 0% | 0 |
| Mitsubishi | 161,523 | 1.5% | 100% | 161,523 |
| Nissan* | 785,719 | 4.8% | 0% | 0 |
| Porsche | 16,773 | 0.2% | 0% | 0 |
| Subaru | 131,330 | 1.1% | 100% | 131330 |
| Suzuki | 70,441 | 0.4% | 100% | 70,441 |
| Toyota | 1,723,027 | 11.2% | 71% | 1,224,449 |
| VW | 372,057 | 2.3% | 0% | 0 |
| Total | 15,546,753 | | 64.3% | 9,778,110 |

*Passenger cars were based on the 2004 Wards Automotive Year Book, December 2004; light trucks/vans with GVWR <= 3,855 kg (8,500 pounds) were based on the Mid-Model Year Fuel Economic Report Data.
**Based on 2005 NCAP survey
[1]2002 figures Some systems collect only vehicle acceleration/deceleration data, while others collect these data plus a host of complementary data, such as driver inputs (e.g., braking and steering) and vehicle systems status. The way in which this is accomplished may be described in the following somewhat simplified manner. The EDR monitors several of the vehicle's systems, such as speed, brakes, and several safety systems. It continuously records and erases information on these systems so that a record of the most recent 8-second period is always available.

If an "event" occurs, i.e., if a crash meeting a pre-determined threshold of severity occurs, as measured by changes in the monitored data, then the EDR moves the last 8 seconds of pre-crash information into its long-term memory. In addition, it records and puts into its long-term memory up to 6 seconds of data relating to what happens after the start of the crash, such as the timing and manner of deployment of the air bags. In general, EDRs are devices that record safety information about motor vehicles involved in crashes. For instance, EDRs may record (1) pre-crash vehicle dynamics and system status, (2) driver inputs, (3) vehicle crash signature, (4) restraint usage/deployment status, and (5) post-crash data such as the activation of an automatic collision notification (ACN) system.

EDRs are devices which record information related to an "event." This event is defined as a vehicle crash. EDRs can be simple or complex in design, scope, and reach. They can make a major impact on highway safety, assisting in real-world data collection to better define the auto safety problem, aiding in law enforcement, and understanding the specific aspects of a crash. It is generally agreed that the more we know about motor vehicle crashes—the better opportunity to enhance vehicle and highway safety. Manufacturers have been voluntarily installing EDRs as standard equipment in increasingly larger numbers of light vehicles in recent years. They are now being installed in the vast majority of new vehicles. The information collected by EDRs aids investigations of the causes of crashes and injuries, and makes it possible to better define and address safety problems. The information can be used to improve motor vehicle safety systems and standards.

As the use and capabilities of EDRs increase, opportunities for additional safety benefits, especially with regard to emergency medical treatment, may become available. EDRs installed in light vehicles record a minimum set of specified data elements useful for crash investigations, analysis of the performance of safety equipment (e.g., advanced restraint systems), and automatic collision notification systems. Vehicle manufacturers have made EDR capability an additional function of the vehicle's air bag control systems. The air bag control systems were necessarily processing a great deal of vehicle information, and EDR capability were added to the vehicle by designing the air bag control system to capture, in the event of a crash, relevant data in memory.

EDRs have become increasingly more advanced with respect to the amount and type of data recorded. Since 1998, the EDR function in light vehicles (under GVWR 10,000 lbs) is typically housed in a control module, such as the sensing and diagnostic module (SDM), the engine control module (ECU) or the stability control or 4-wheel steering modules. These modules are located in various places in the vehicle, such as under a front seat, in the center console or under the dash. Current EDR designs were developed independently by each automaker to meet their own vehicle-specific needs.

Both the data elements and the definition of these data elements vary from EDR to EDR. Both GM and Ford, for example, record vehicle impact response vs. time—i.e., a crash pulse. GM, however, stores the crash response as a velocity-time history recorded every 10 milliseconds while Ford stores the crash response as an acceleration-time history recorded every 0.8 millisecond, e.g. stored in the Ford Windstar RCM. Even for a given automaker, there may not be a standardized format. The GM SDM, for example, has evolved through several generations.

Until recently, there has been no industry-standard or recommended practice governing EDR format, method of retrieval, or procedure for archival. The preferred method is to connect to the onboard diagnostic connector located in the occupant compartment under the instrument panel. Despite the obvious safety benefits that might accrue, however, the use of EDRs has not been without controversy. EDRs were designed to help automakers build safer vehicles. But manufacturers have used the data to defend against product liability claims. Police investigators have also increasingly been using the data to charge drivers with speeding violations and more serious vehicular crimes. And insurance companies want the data to dispute unwarranted claims and tie policy rates to driving behavior.

Privacy advocates and consumer groups oppose allowing data collected for safety purposes to be used for other purposes, especially when most drivers are unaware that their cars have boxes or mechanisms that can be used as evidence against them. They also question whether the data is accurate, since few tests have been conducted to establish its reliability. A number of research studies have concluded that although the EDR data (and the recorder itself) may be "owned" by the automobile's owner or lessee, that data may almost certainly be used as evidence against the owner (or other driver) in civil or criminal cases.

Furthermore, nothing within the federal rules of evidence or the Fifth Amendment's protection against self-incrimination would exclude the use of data recorded by EDRs. Similarly, owners might be prohibited from tampering with the data. Even where statutory authority to require EDRs exists, the public may not want open, unrestricted access to a device installed in their automobiles because unrestricted access may appear to impede their personal privacy interests. Thus public acceptability of EDRs is an important issue paralleling the legal issues raised by EDRs. For example, a class action suit, filed in New Jersey in 2000, alleged that General Motors never told owners of their vehicles that EDRs were installed. The public is largely unaware of EDR systems, how they operate, and who has access to the driving information that can be read from these systems.

At present, vehicle crash data from EDRs is accessible by law enforcement, automakers, state and federal government agencies, automotive repair facilities and automotive insurance companies. Four states—Arkansas, Nevada, North Dakota and Texas—followed the example taken by California lawmakers in 2003 and have enacted laws that specify how motor vehicle event data recorders ("EDRs" or auto "black boxes") are to be regulated in their respective jurisdictions. Similar legislation is being considered in New York, Massachusetts, New Jersey and Pennsylvania. In another seven states—Alaska, Connecticut, Montana, New Hampshire, Tennessee, Virginia and West Virginia—EDR bills were introduced in 2006, but they failed to pass before those legislatures adjourned.

In a Jan. 6, 2006 editorial USA Today noted that "It's common knowledge that airplanes have 'black boxes' that record flight data so safety experts can reconstruct what went wrong after an accident. But few motorists are aware that their late-model cars contain similar devices—and that police and insurers might use the data against them. Six states (Arkansas, California, Nevada, New York, North Dakota and Texas) have recently passed laws requiring that automakers notify motorists of the devices, known as event data recorders (EDRs), and limiting access to them. Nevada's law, which took effect Jan. 1, 2006, requires the owner's permission before data can be retrieved."

The devices are the size of a pack of cigarettes and are in more than 70% of all new passenger vehicles. The National Transportation Safety Board (NTSB) wants them in every new car sold in America, but privacy concerns have slowed that effort. EDR data monitoring speed, braking, seat-belt use, steering and more can sort out responsibility for accidents and lead to improved vehicle design. But other uses of the data may be made by police, auto insurers, and litigants. Few guidelines exist for resolving who owns the data, and court rulings vary. EDRs can lead to safety improvements, but in response to privacy concerns the federal government may require that all affected motorists are informed that the devices are present in their vehicles.

NHTSA's EDR research website lists the following potential users and consumers of EDR data: insurance companies, vehicle manufacturers, government, law enforcement, plaintiffs, defense attorneys, judges, juries, courts, prosecutors, human factors research, state insurance commissioners, parents' groups, fleets and drivers, medical injury guideline data usage, vehicle owner and transportation researchers and academics, with the auto industry as one of the major future consumers of EDR data. This large, broad and unregulated list of people and entities with the potential ability to get access to private information from an EDR without the driver's consent is alarming and disturbing to many consumers. Invasion of privacy, violation of constitutional rights of the vehicle owners, and ambiguity regarding ownership of the EDR data are fundamental reasons for opposition to these technologies. The data an EDR records could be decisive in a criminal or civil case. Further, a driver's insurance coverage might someday depend on information collected from an EDR. Important rights could be at stake.

Since vehicles have a universal serial bus diagnostic link connector port to accommodate connecting peripheral devices such as electronic scan tools capable of re-engineering and altering odometers this has given rise to vehicle tampering. Under current practice, anyone with access to a vehicle may plug a portable scan tool device with a flash memory card and interface into the diagnostic link connector port and copy (or tamper with) information in the vehicle Controller Area Network (CAN). Since portable flash memory cards are usually very small, removing the portable flash memory card from the diagnostic link connector port and taking the information out of the vehicle is relatively easy.

Since the loss of proprietary and confidential information can be very costly with regard to lost revenue and corporate liability, most automakers take significant security precautions to protect against the theft of corporate information. Some companies take steps to keep vehicle information from being downloaded without proper authorization. Rental car companies and automotive lease dealers would suffer economically from widespread tampering with vehicle status information, including information accessible through the diagnostic link connector. After-market products are currently available such as the Uif Technology Co., Ltd., (Shenzhen, China) which advertises a "Mileage Correction Kit" which is marketed as "a compact interface that will allow you to easily read/write/modify the mileage/km of your car without the need to remove the dash. It connects to the on-board diagnostics port located in your car."

It is estimated that every year, more than 89,000 vehicles with tampered odometers reach the Canadian marketplace at a cost to Canadians of more than $3.56 million according to estimates by a United States of America based company called CarFax. A 2002 U.S. National Highway Traffic Safety Administration study shows that each year more than 450,000 Americans will inadvertently buy a used vehicle with the mileage gauges rolled back. That makes tampering with odometers a $1.1-billion-a-year industry in the United States of America alone.

The definition of tampering can be extended to any means used to modify, remove, render inoperative, cause to be removed, or make less operative any device or design element installed on a motor vehicle or motor vehicle power-train, chassis or body components which results in altering federal motor vehicle safety standards (FMVSS). Required installation of EDRs and the availability of EDR data that is accurate and has not been altered by tampering may be viewed as part of a comprehensive system of safety standards. Automotive insurance companies also have an interest in assuring that real-time crash data generated by EDR devices has not been altered by tampering.

Further, however, unless improved mechanisms to prevent unauthorized access become available, increased consumer awareness of the existence and accessibility of EDR data may prompt a consumer revolt against the installation of EDRs. This could negatively impact sales and/or lead many manufacturers to offer owners the option to turn off their EDRs; there could even be pressure to stop installation of these devices altogether. Such developments would seriously limit the amount of EDR data collected for research by personnel in law enforcement, insurance, government, manufacturing, and education.

The Electronic Privacy Information Center (EPIC) suggests that strong privacy safeguards might further any public safety interests by promoting adoption of the technology by drivers who, under present circumstances, do not feel the presence of these devices are worth the risk. Consumers Union (Docket # NHTSA-2002-13546-79) believes the most important issue to consider regarding traceability of EDR data is the balance between protection of consumer (i.e., vehicle owner) privacy and utility of the captured data. Thus, there is a recognized need to provide both a means of consumer protection for permitting EPA mandated OBD data related to engine and emissions diagnostic data to be downloaded by service technicians and vehicle emission inspection stations while at the same time securing crash data for vehicle owners, thereby protecting privacy and avoiding tampering in an inexpensive and useful manner.

In recent years advances in telecommunications have created an industry called "Telematics." Telematics is a wireless communications system designed for the collection and dissemination of information, particularly in reference to vehicle-based electronic systems, vehicle tracking and positioning, on-line vehicle navigation and information systems and systems for providing emergency assistance. Such developments hold out the promise of improved safety and services to motorists, but these improvements may be delayed or compromised if consumer concerns about unauthorized access to EDR devices are not addressed.

The increasingly electronic-driven nature of new vehicles has made it difficult for consumers to either diagnose malfunctions in their vehicles or to repair them. Even professional mechanics must now rely on sophisticated electronic equipment to diagnose and repair vehicular malfunctions. To better aid in the diagnosis of such vehicular malfunctions, passenger cars have been required, since 1996, to include an on-board diagnostic port (OBD port), or a diagnostic link connector (DLC). An OBD or DLC essentially comprises a plug-in type connector that is coupled to the on-board computer in the vehicle. The on-board computer is coupled to various sensors at various places within the vehicle, to sense the existence of a malfunction in the various locations of the vehicle. By plugging in an appropriate "scanner" device into the OBD or DLC, error codes can be retrieved. These error codes provide information as to the source of the malfunction.

Typically, the scanner devices used today to retrieve such error codes from an OBD or DLC port are large, complex, and—importantly—expensive. The devices typically include a data processing computer, having a cable that can be coupled to the OBD or DLC port. The error codes are retrieved from the vehicle, and fed into the processing unit of the device. The processing unit of the device includes software for processing the information retrieved from the error code, which, along with a database of information, correlates the error codes to specific vehicle malfunction conditions.

As noted in U.S. Pat. No. 6,957,133 to Hunt, et al., most vehicles manufactured after 1996 include a standardized, serial 16-cavity connector, referred to herein as an 'OBD-II connector', that makes these data available. The OBD-II connector serially communicates with the vehicle's Electronic Controller Units (ECUs) and typically lies underneath the vehicle's dashboard. Conventional GPSs can be combined with systems for collecting the vehicle's OBD-II diagnostic data to form 'telematics' systems. Such telematics systems typically include (1) a microprocessor that runs firmware that controls separate circuits that communicate with different vehicle makes (e.g., Ford, GM, Toyota) to collect OBD-II data; (2) a GPS module; and (3) a separate wireless transmitter module that transmits the GPS and OBD-II data.

Privacy is the single most important issue affecting the success or failure of implementing the Event Data Recorder. In a position paper presented to the NHTSA EDR Working Group titled *Information Privacy Principles for Event Data Recorder* (EDR's) Technologies (Kowalick, 1998) it was noted that individual motorists or others within motor vehicles have an explicit right to privacy. Although this right to privacy is not explicitly granted in the Constitution, it has been recognized that individual privacy is a basic prerequisite for the functioning of a democratic society. Indeed an individual's sense of freedom and identity depends a great deal on governmental respect for privacy. Therefore all efforts associated with introducing future EDR technologies must recognize and respect the individual's interests in privacy and information use. Thus, it is imperative to respect the individual's expectation of privacy and the opportunity to express choice. This requires disclosure and the opportunity for individuals to express choice, especially in regards to after-market products. Current OEM EDR technology limits an individual's expression of both privacy and choice.

There is a market and established method for diagnostic inspection, repair and maintenance of motor vehicles. However, there is also an emerging shadow market for re-engineering of in-vehicle electronics (such as odometers). The resale value of a vehicle is often strongly influenced by the number of miles or kilometers a passenger vehicle has on the odometer, yet odometers are inherently insecure because they are under the control of their owners. Many jurisdictions have chosen to enact laws which penalize people who are found to commit odometer fraud. In the US (and many other countries), vehicle maintenance workers are also required to keep records of the odometer any time a vehicle is serviced. Companies such as Carfax then use this data to help potential car buyers detect whether odometer rollback has occurred.

As described above, the vehicle diagnostic port can be used and misused for a variety of purposes. The diagnostic port provides a common portal for a variety of information, including information that can be used to the disadvantage of the owner/motorist. At present this portal remains unprotected from uses not authorized by the owner, a situation that is not viable for consumers and therefore likely to retard effective exploitation of the beneficial potential of this portal.

Therefore, a more practical and convenient means of preventing casual and unauthorized downloading of information from EDR devices is needed. Such a means is needed not only to protect the privacy of vehicle owners and motorists, but to build an acceptance of the portal among consumers as owner/motorists so that the portal will be available for data useful to the development of safer vehicles and improved services and products for the driving public. Further, the means that are needed must not interfere with or obstruct current practices that are designed to prevent the owner/motorist from tampering with data such as the odometer record of total vehicle mileage.

SUMMARY OF THE INVENTION

To overcome the shortcomings, the present invention provides a lockout apparatus for a diagnostic link connector port to mitigate or obviate the aforementioned problems.

The main objective of the present invention is to keep unauthorized peripheral devices from being connected to a vehicle onboard diagnostic link connector universal serial bus port without the consent or knowledge of vehicle owners (or operators) by providing means to deny physical access to the port, by attaching a connector lockout apparatus onto the diagnostic link connector port. This objective does not reduce, obstruct or hamper legitimate usage of the diagnostic link port for vehicle inspection, analysis of vehicle emissions, maintenance, or repair of the vehicle since these tasks are generally performed with the knowledge and consent of the owner or operator. The invention is specifically concerned with securing vehicle crash data, preventing mischief and misuse and thereby increasing consumer knowledge and acceptance of event data recorder technologies.

The onboard diagnostic link connector vehicle plug has 16 pins. Normally this female plug is only equipped with the metal pins that the car needs in order to satisfy the protocols that its Electronic Controller Units (ECUs) "speak". Therefore, it is possible to "predict" which protocol(s) a car complies with, just by looking at those pins. While the OBDII standard defines a single data protocol and physical connector, it allows different electrical interfaces to be used such as J1850 PWM, J1850 VPW, and ISO-9141-2. More electrical interfaces are being approved for OBDII purposes such as KWP2000 and CAN (Controller Area Network).

This invention teaches a useful and novel means to construct a variety of locking systems, either mechanical or electro-mechanical, or a combination of both, to prevent unauthorized connection and access to vehicle crash data. As an example, in one embodiment this task is accomplished by utilizing one or more of the empty pin spaces as a locking pin(s), comprising a lockout mechanism. However, automakers may choose to modify future pin spacing that would negate this locking method.

Automakers have several choices regarding suppliers for the vehicle diagnostic port connector. As example: Delphi Packard, Tyco and Molex produce slightly different versions. There are minor differences in these connectors which makes it challenging to create a universally useful lockout apparatus. This invention teaches a new and novel method to do so. The preferred embodiment of the invention uses a raised protrusion, located in the common space below the two rows of pin spacing, as a locking point. The protrusion, as described hereafter, is a square or rectangular shaped portion extending from the casing of the diagnostic port connector in the direction of a mating connector but outside the pin housing. This protrusion is universal to all manufacturers and standardized by the Society of Automotive Engineers (SAE) and the International Standardization Organization (ISO). The preferred embodiment provides a blocking mating connector with a pressure mechanism for clamping the mating connector to the protrusion. In the preferred embodiment the pressure mechanism is activated and released mechanically by operation of a key in a key lock which is an integral part of the mating connector, where rotation of the key to the locked position in the key lock applies pressure to the protrusion so as to clamp the blocking mating connector to the protrusion. By turning the key to the unlock position and pressing a latch release the blocking mating connector may be removed.

This preferred mechanism for implementing the invention has the advantage of simplicity and ease of construction with existing key-lock mechanisms. The preferred mode of the invention may also be implemented with other mechanisms for applying a clamping pressure to the protrusion. For example, an electro-mechanical mechanism could be used, and such a mechanism could be operated remotely using a coded radio signal. Other variations of this new and novel locking clamp methodology may also be used, based on variations in protrusion shape and size, to secure the diagnostic link connector without disturbing the electrical function of the vehicle sub-system.

A secondary objective of the invention is to provide rapid and accurate delivery of secure roadside medical information closer to the point and time of incident—during emergency roadside medical care at the scene. The standardized location of the diagnostic link connector provides a common point of reference for securing roadside medical information. One embodiment of the invention calls for a microchip application to store via the lockout device (i.e. the blocking mating connector) information specific to the individual such as name and address, physical description, digital photograph, current medications, allergies and chronic conditions, recent procedures, special instructions, emergency contacts and insurance. In this implementation of the invention, the blocking mating connector is configured to use data pins on the blocking mating connector for transmission of this information from the microchip application mounted on or within the blocking mating connector.

This vital information is invaluable in life threatening conditions caused by vehicle crashes. Information is entered pre-crash by programming the microchip and inserting it into the interface located on or within the connector lockout apparatus. Post-crash upon arrival of emergency personnel this information is readily available via a PDA or laptop computer.

An aspect of the invention is a vehicle connector lockout apparatus comprising means for attaching a blocking mating connector to a vehicle diagnostic port connector, means for locking the blocking mating connector to the vehicle diagnostic port connector, and means for unlocking the blocking mating connector from the vehicle diagnostic port connector. In another aspect, the attaching means comprises a connector shell adapted to mate to the diagnostic port connector while leaving exposed a portion of a protrusion from the diagnostic port connector, where the locking means further comprises means for clamping the lockout apparatus to the protrusion and means for disabling the unlocking means. A further aspect of the invention provides that the clamping means further comprises a lock assembly mounted within a housing, the housing being attachable to the connector shell, a locking clamp mounted within the housing and extending over the attached connector shell and over the protrusion when the connector shell is connected to the diagnostic port connector, where the lock assembly operates to press the locking clamp against the protrusion upon operation of the locking means, the housing and attached connector shell thereby being clamped to the protrusion. In another aspect of the invention, the lock assembly contains a keyed opening and is operable by turning a key inserted into the keyed opening. Also, the lock assembly can be made operable by receiving a coded signal.

A further aspect of the invention provides that the lock assembly further comprises a cylinder behind the keyed opening, a cam being supported by the cylinder and positioned such that turning the key forces the cam against a first portion of the locking clamp so as to press a second portion of the locking clamp against the protrusion. Also, the locking clamp can have a raised button on the first portion, the locking clamp being aligned within the housing so that button protrudes through a hole in the housing, where the unlocking means further comprises insertion of the key into the keyed opening, turning the key so as to release the pressure applied by the cam, and pressing the button to lift the second portion of the locking clamp from contact with the protrusion. In another aspect, the invention further comprises a microchip memory component for storage of information applicable to an operator of the vehicle. The information stored includes one or more of: timestamp, vehicle ownership, vehicle identification number (VIN), insurance, personal medical data, and health care provider information. Where the information stored includes an identification number assigned to the connector lockout apparatus, and that identification number is usable to obtain a vehicle identification number for the vehicle when the connector lockout apparatus is plugged into a computer device that is capable of accessing the Internet.

BRIEF DESCRIPTION OF THE DRAWINGS

The foregoing and other objects, aspects and advantages of the invention will be better understood from the following detailed description of a preferred embodiment of the invention with reference to the drawings, in which.

DETAILED DESCRIPTION OF A PREFERRED EMBODIMENT OF THE INVENTION

Figure 1:
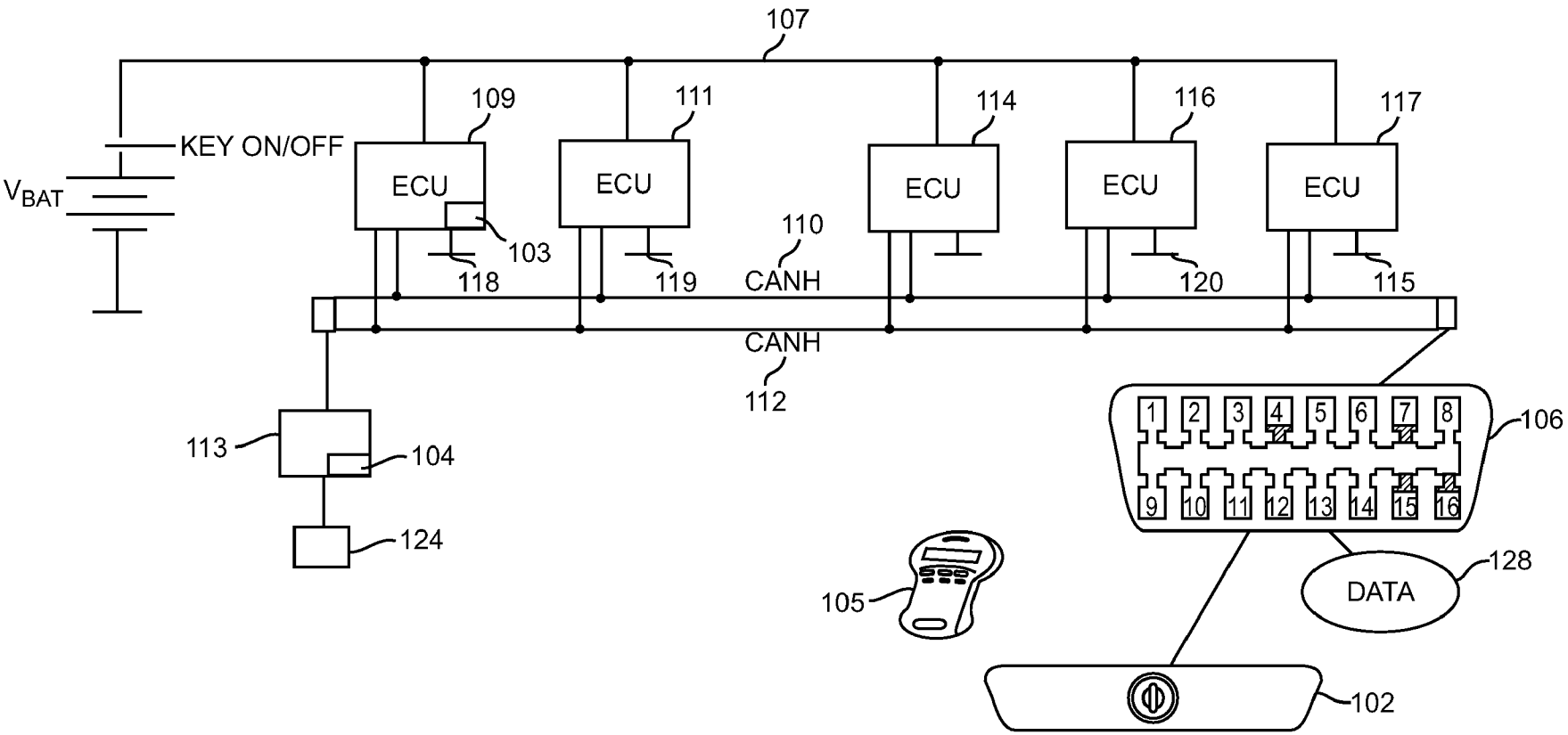
FIG. 1 is a schematic view illustrating the overall automotive vehicle system to which the invention is applied.

The present invention will now be described with reference to the attached drawings. The present invention hampers and prevents access to and thus misuse of motor vehicle information systems and crash data by providing a means to restrict physical access to the vehicle diagnostic link connector port, which is located under the vehicle dashboard as illustrated in FIGS. 1B and 1C. Turning to FIG. 1A, there is shown an overview of the lockout device 1 (shown as item 102 in FIG. 1) as connected to a vehicle diagnostic port 2. The device has a front wall 3, a rear wall 4, two side walls (e.g. 5) and a top wall 6 and bottom wall 7. There is an open security slot 8 and a cylindrical or button assembly 9. A locking plate 10 contains a hole 11. The device 1 is made operable by mating to a diagnostic connector 2 having a protrusion 12, and turning key 20 to clamp the locking plate 10 to the protrusion 12. Key 20 is inserted into keyed opening 31, and turning the key 20 rotates cylinder 32 to which is attached cam 34. There is a nut 33 for attachment of the lock assembly to the housing.

The lockout device is comprised of four major components: 1) the mini lock assembly and sub-parts, 2) the connector shell apparatus and embedded microchip fob, 3) the locking clamp with push-button or fulcrum lever clamp subpart and 4) the bottom protective cover. Turning the key on the lock assembly rotates a cam that is attached to the barrel. In one embodiment (as described in connection with FIGS. 2A, 2B, 3A, 3B, 3C, 4A and 4B) when the cam rotates it places a force (pressure) on the locking plate that is attached to the locking apparatus, which then covers the protrusion 12, thereby securing the locking apparatus to the diagnostic link connector. A reverse movement of the key, while simultaneously pushing down on the push button 9, releases force on the locking plate 10 and opens the vehicle security lockout connector. In the preferred embodiment (as described in connection with FIGS. 2C, 2D, 4C, 4D, 5A, 5B, 6A, 6B and 7) when the cam rotates it places a force on a first end of a clamp lever, which then rotates about a fulcrum of the lever thereby causing the other end of the lever to lock against the protrusion 12. A reverse movement of the key (without pushing any button as in the first embodiment) releases the force on the first end of the clamp lever, which in turn is translated via the fulcrum into release of the lock pressure of the other end of the lever against the protrusion 12, thereby opening the vehicle security lockout connector.

Figure 2B:
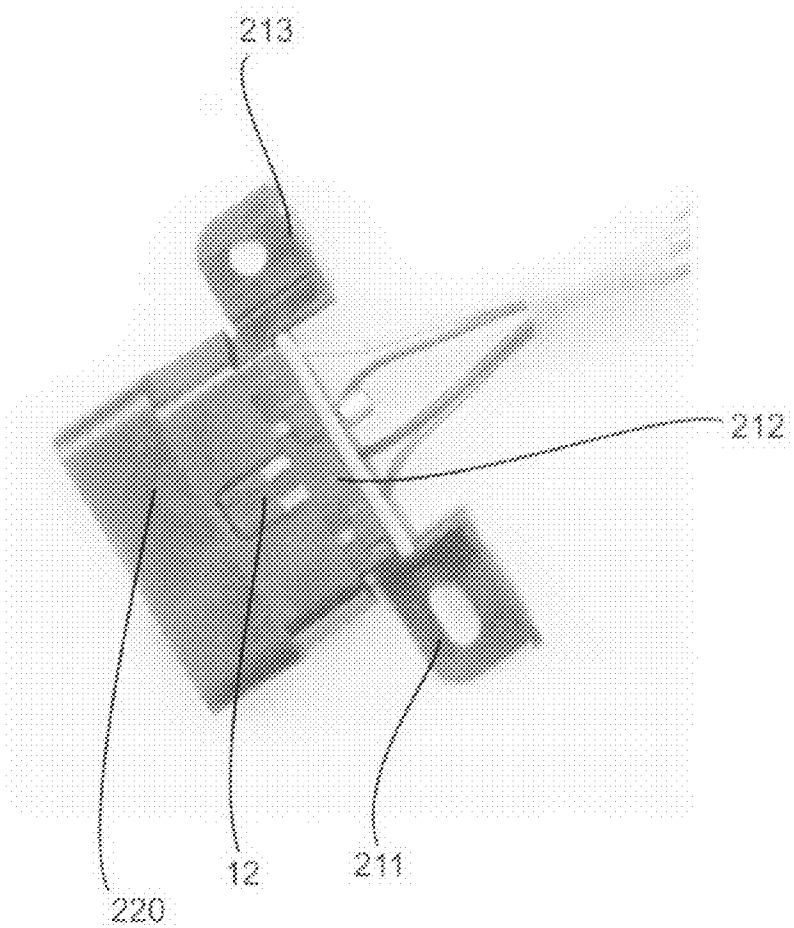
FIGS. 2A and 2B show the connector shell of the invention.
Figure 2A:
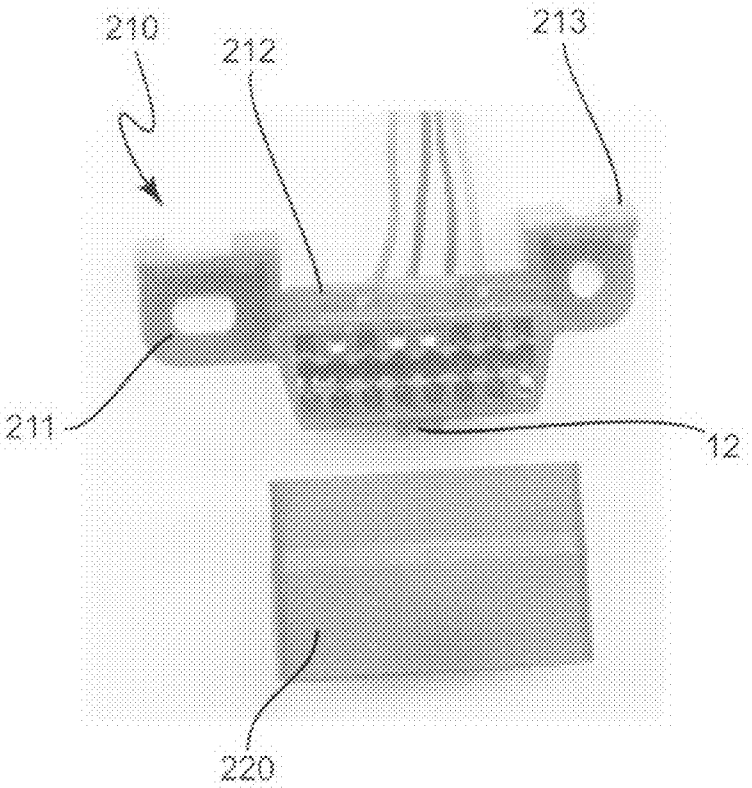
Figure 2C:
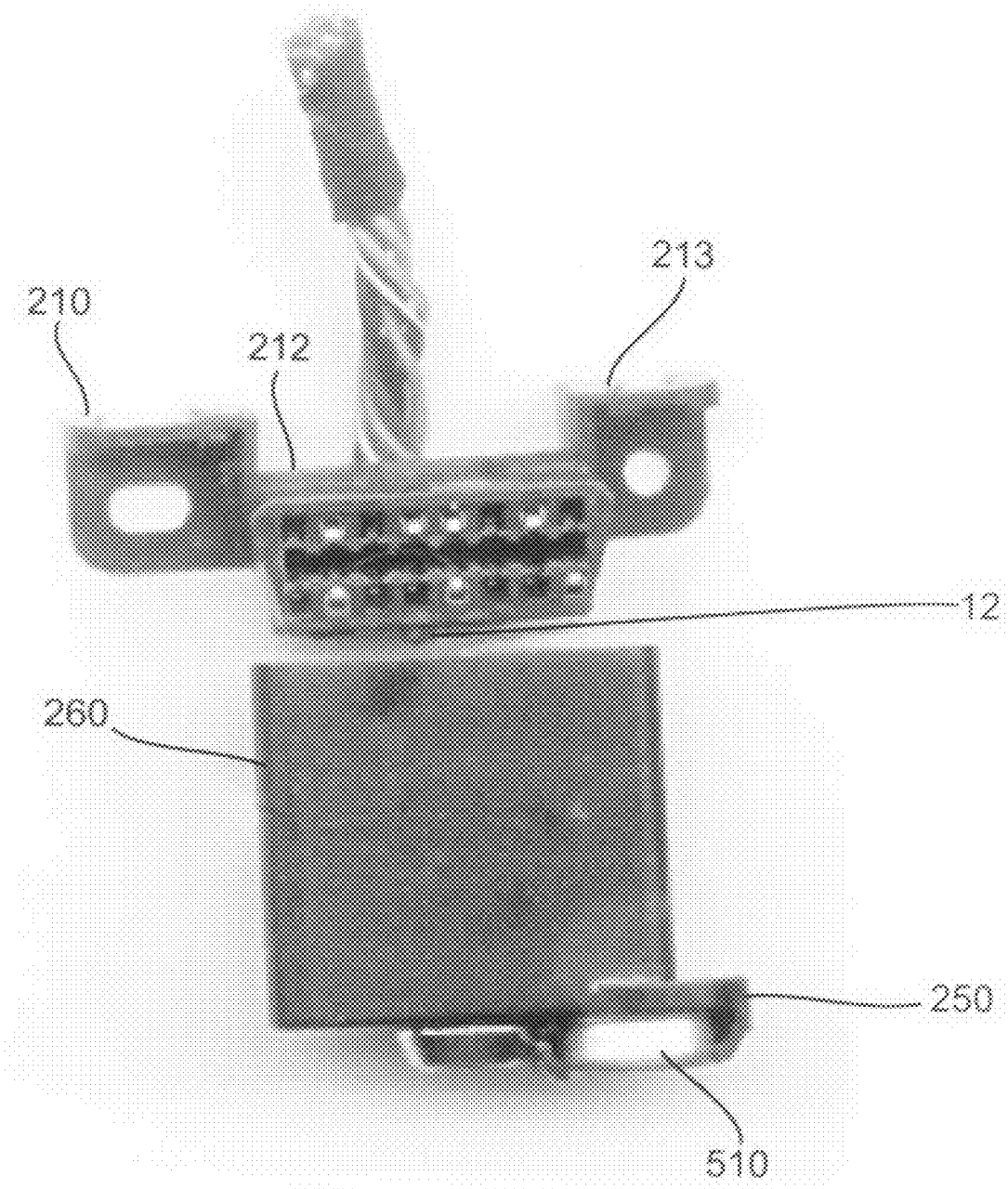
FIGS. 2C and 2D show the connector shell in a preferred embodiment having an embedded microchip.
Figure 2D:
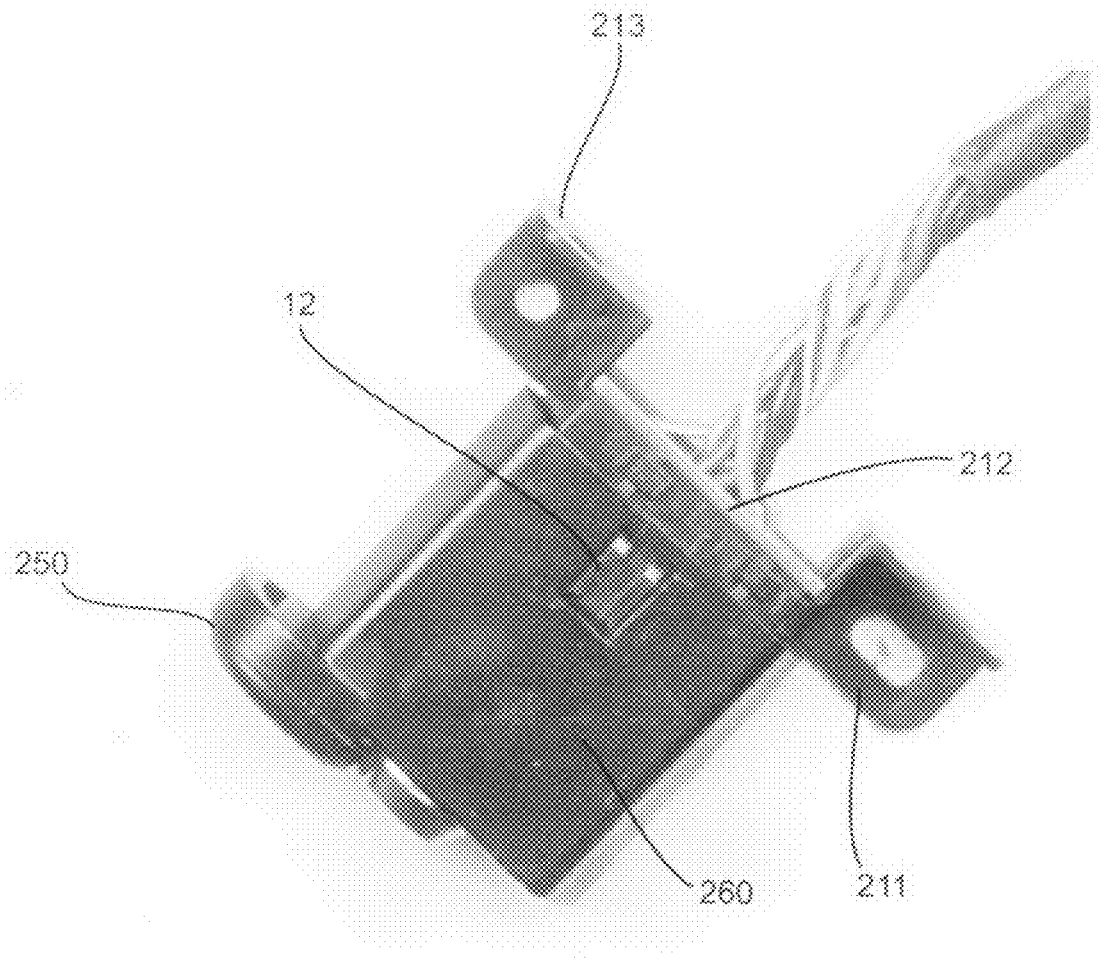

Turning now to FIGS. 2A and 2B there is shown the connector shell 220 which is adapted to fit over the diagnostic port connector assembly 210, which is comprised of diagnostic port connector 212 and mounting flanges 211 and 213. Note the protrusion 12 shown on the underside of the diagnostic port connector 212 in FIG. 2A, and on the reverse orientation in FIG. 2B where the connector shell 220 is shown as attached to the diagnostic port connector 212. FIGS. 2C and 2D, respectively, also show the protrusion 12 on the diagnostic port connector 212, comparably to FIGS. 2A and 2B, respectively, but show a view that is different in two respects. The view of the invention shown in FIGS. 2C and 2D include housing 260, which is a single unit not requiring connector shell 220, which is therefore not shown. Further, FIGS. 2C and 2D show a preferred embodiment that also includes an embedded microchip housing 250 in the housing 260 of the blocking mating connector.

Figure 3B:
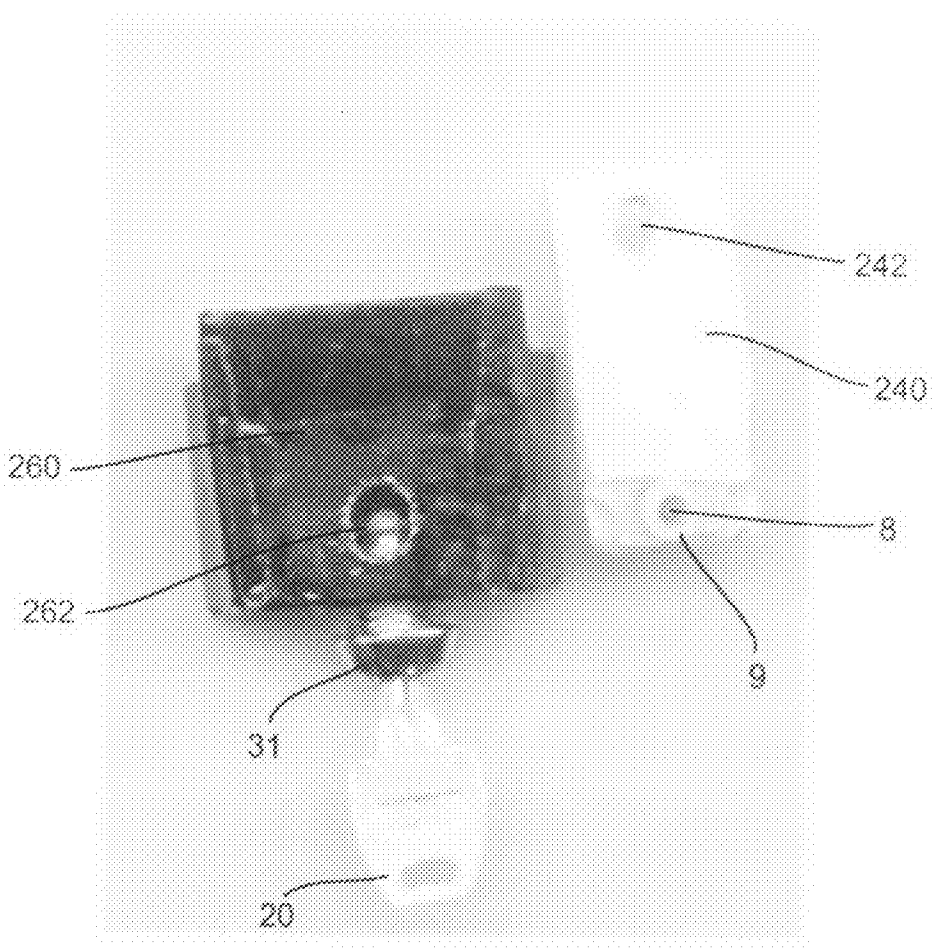
FIGS. 3A and 3B show the housing and lock assembly of the invention.
Figure 3A:
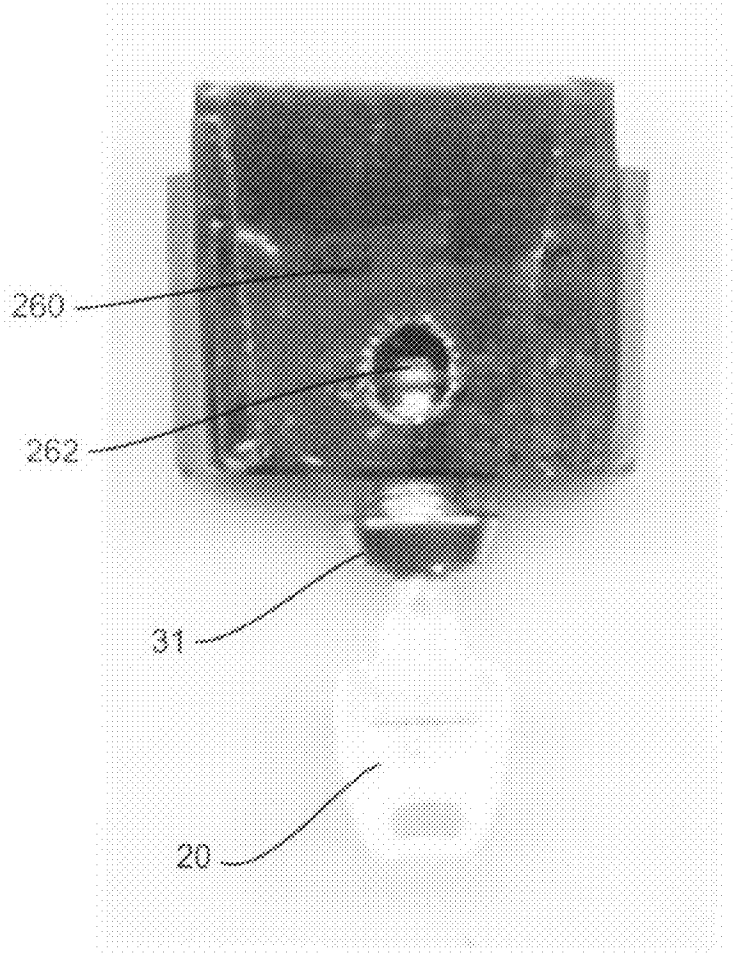
Figure 3C:
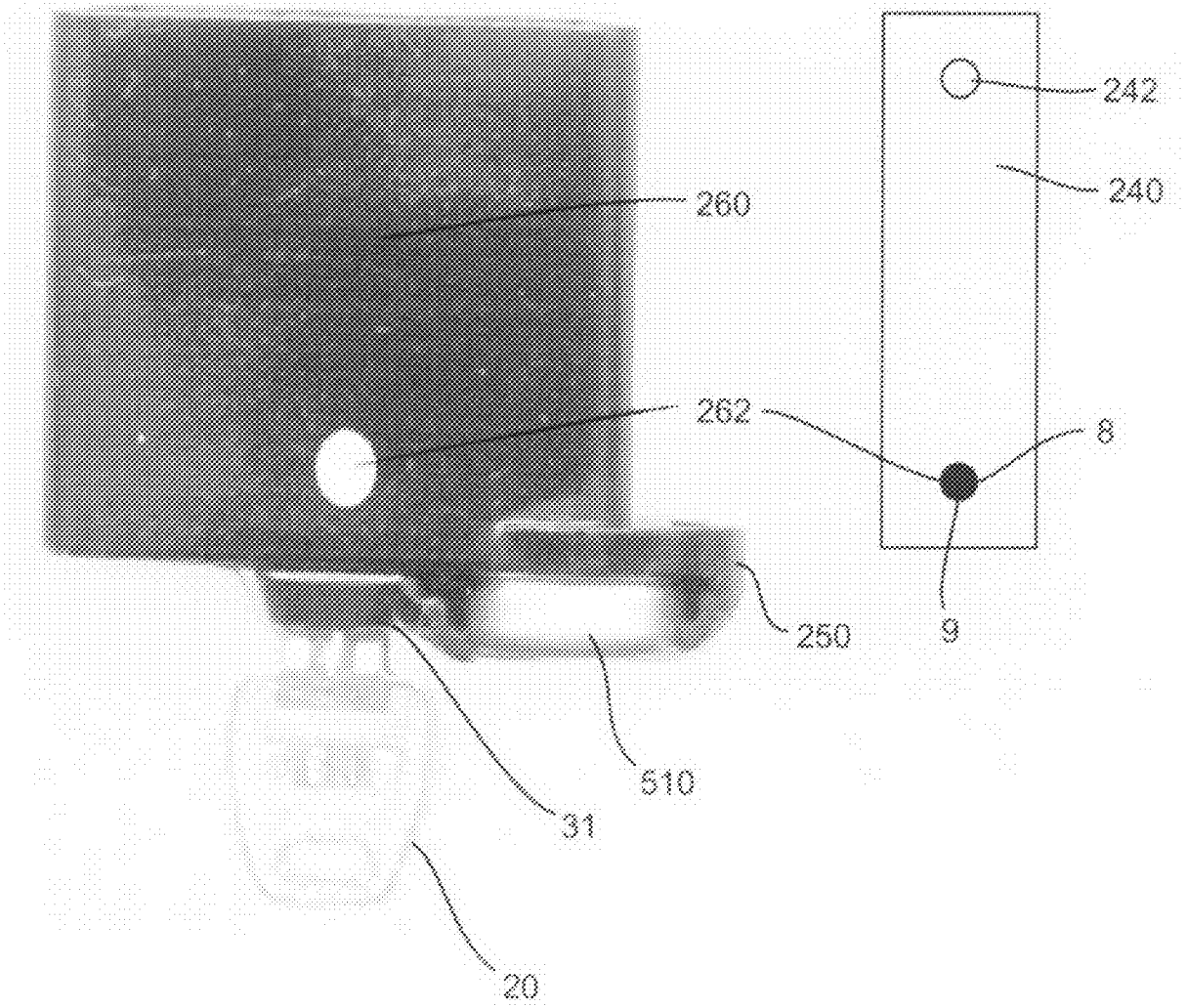
FIG. 3C shows the housing and lock assembly with an embedded microchip.
Figure 4A:
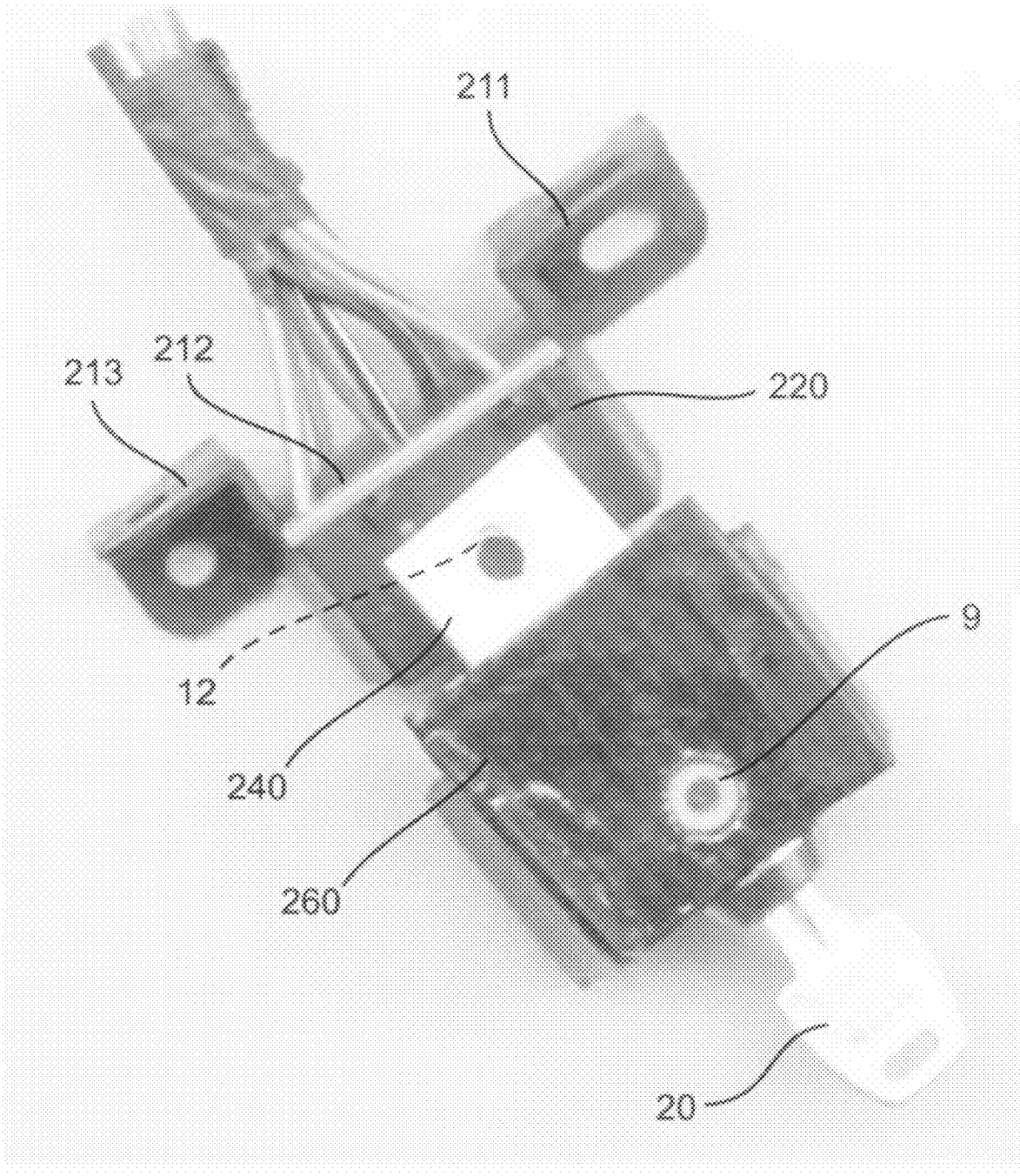
FIGS. 4A and 4B show assembly of the connector shell, housing and lock assembly, and attachment to the diagnostic port.
Figure 4B:
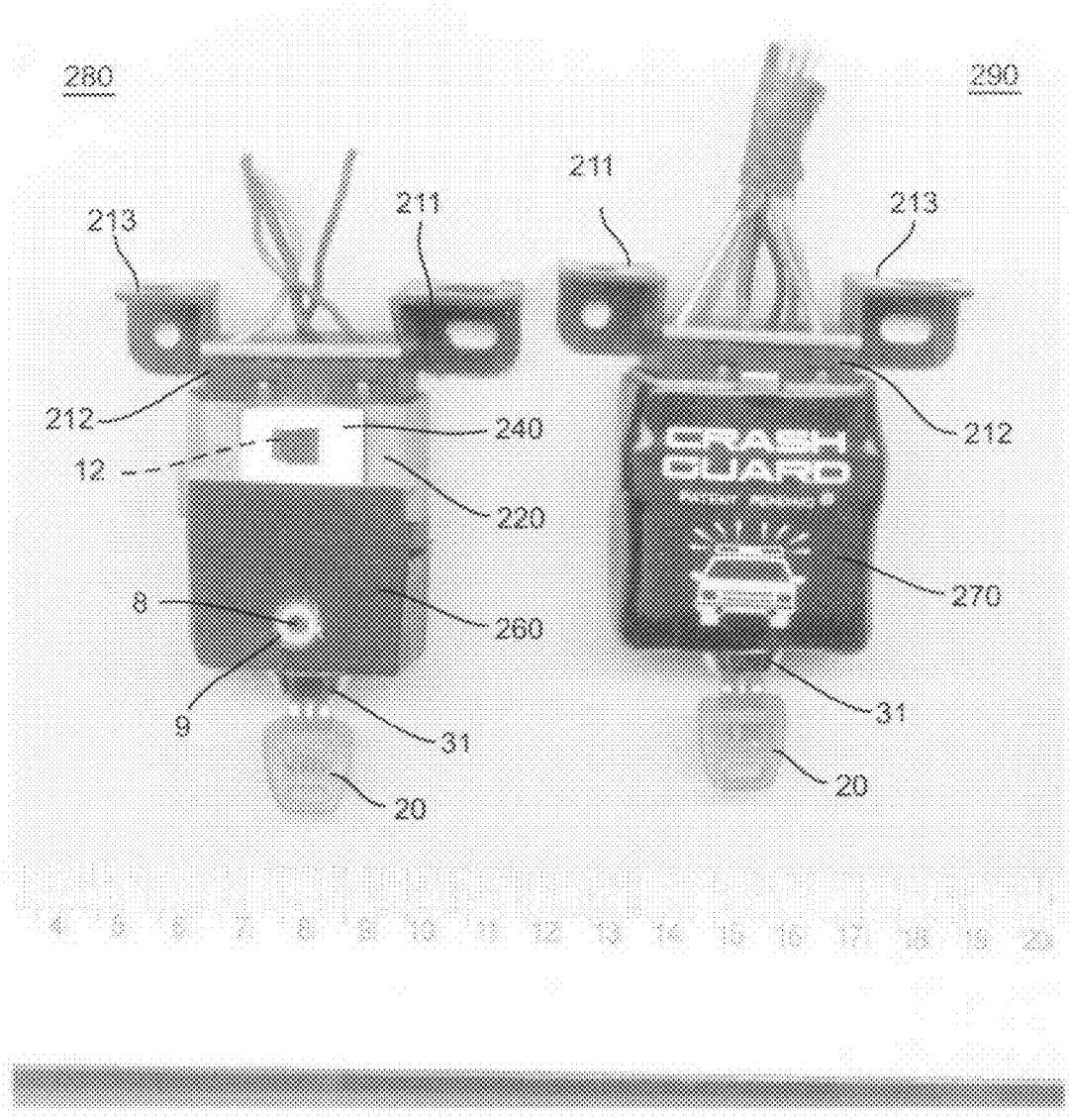
Figure 4C:
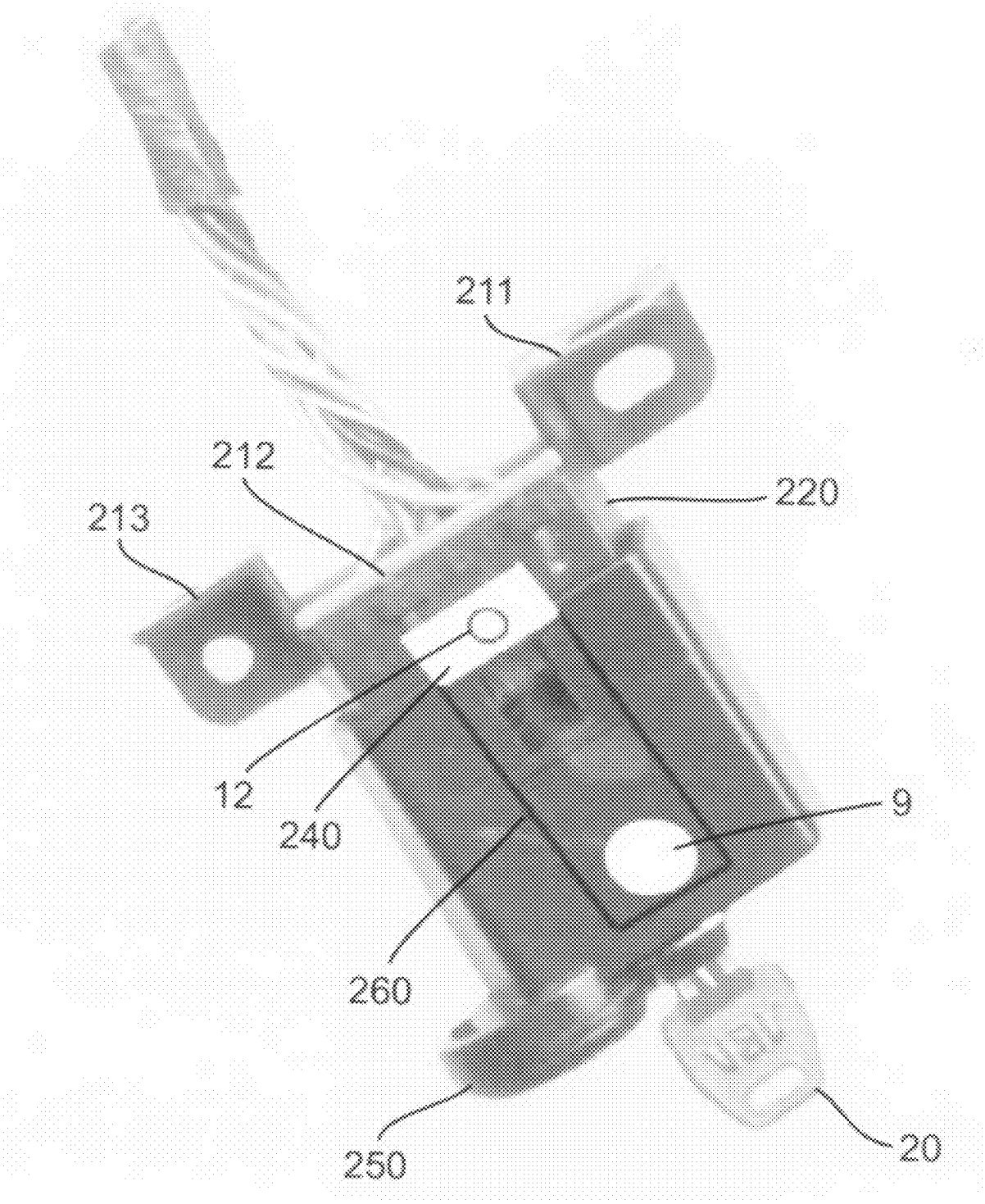
FIGS. 4C and 4D show assembly of the housing and lock assembly in a preferred embodiment having an embedded microchip.
Figure 4D:
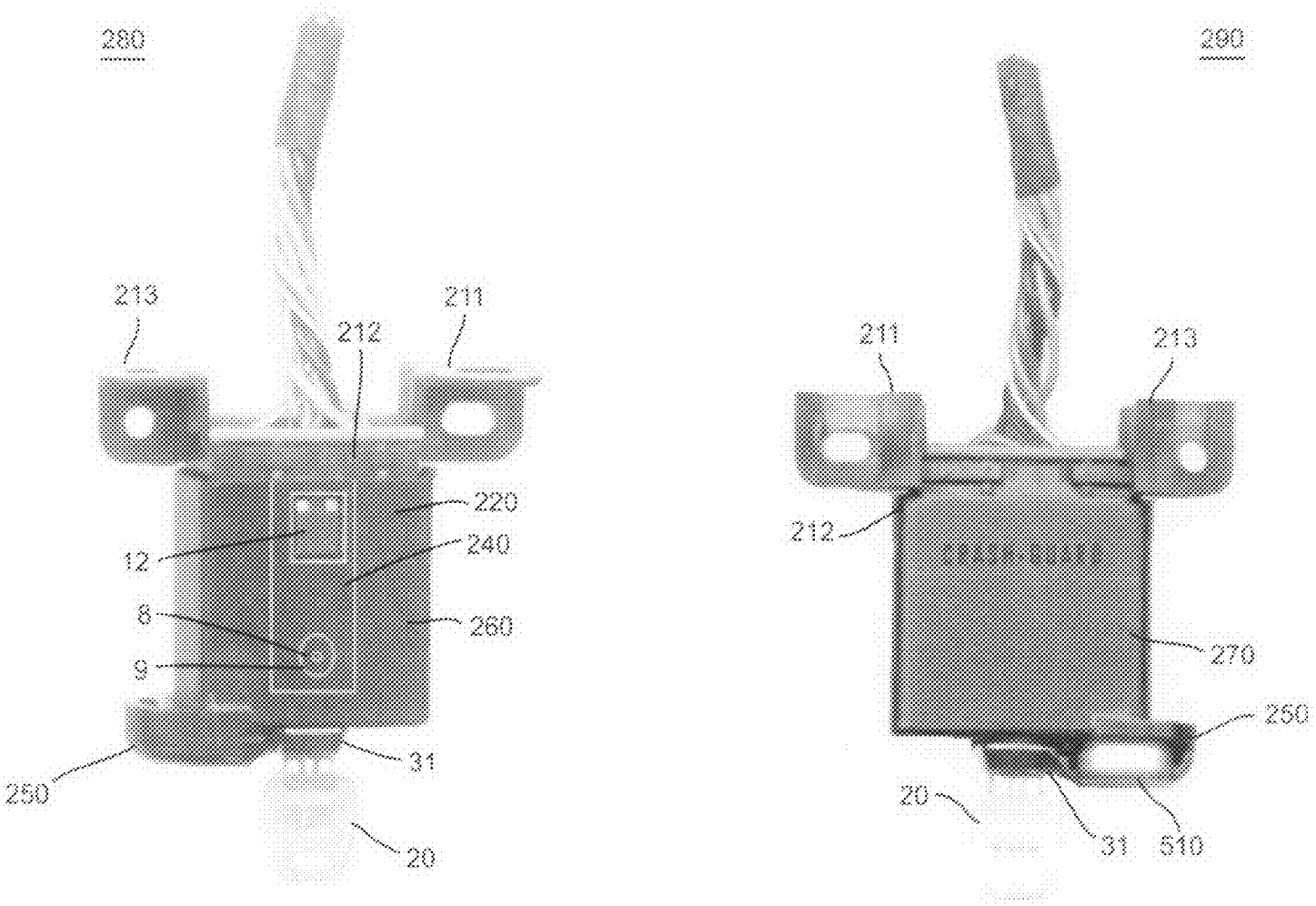

The housing and lock assembly of one embodiment are shown in FIGS. 3A, 3B and 3C. Note the hole 262 in housing 260 designed for pushbutton 9 on locking plate 240 (item 10 in FIG. 1A) having hole 242 (item 11 in FIG. 1A). These parts are assembled as shown in FIG. 4A. Locking plate 240 is positioned in housing 260 so that button 9 protrudes through the hole 262 in the housing. Note that the protrusion 12 is obscured by the locking plate 240 and the connector shell 220. The lockout device is further shown in FIG. 4B, where the left panel 280 shows the device without the vinyl covering 270 shown in the right panel 290 (FIG. 3B). A variation of this embodiment is shown in FIG. 3C, where an embedded housing 250 (for microchip 510) is shown in the housing 260.

Figure 5A:
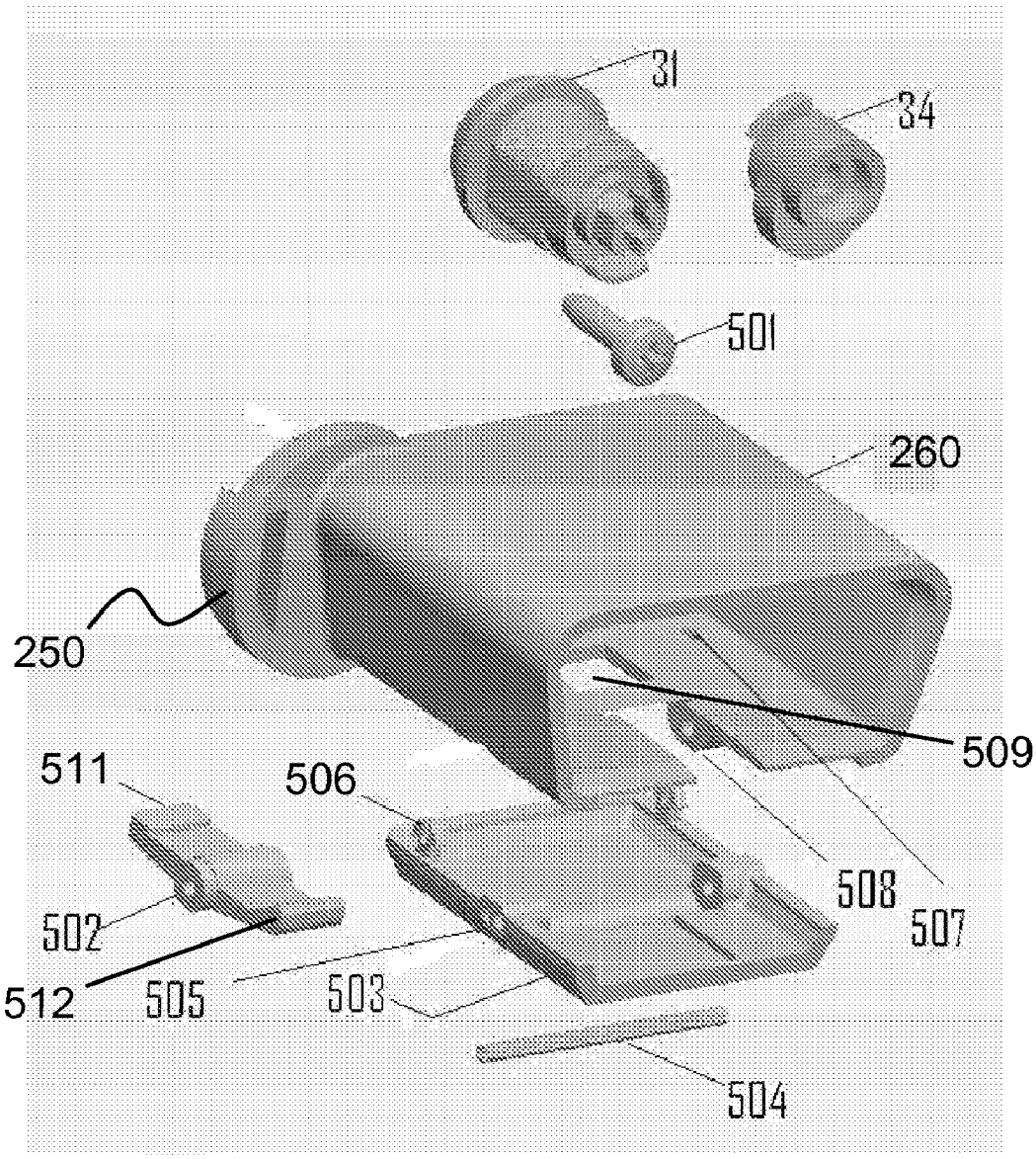
FIGS. 5A and 5B show assembly of the vehicle connector lockout apparatus including the microchip.
Figure 5B:
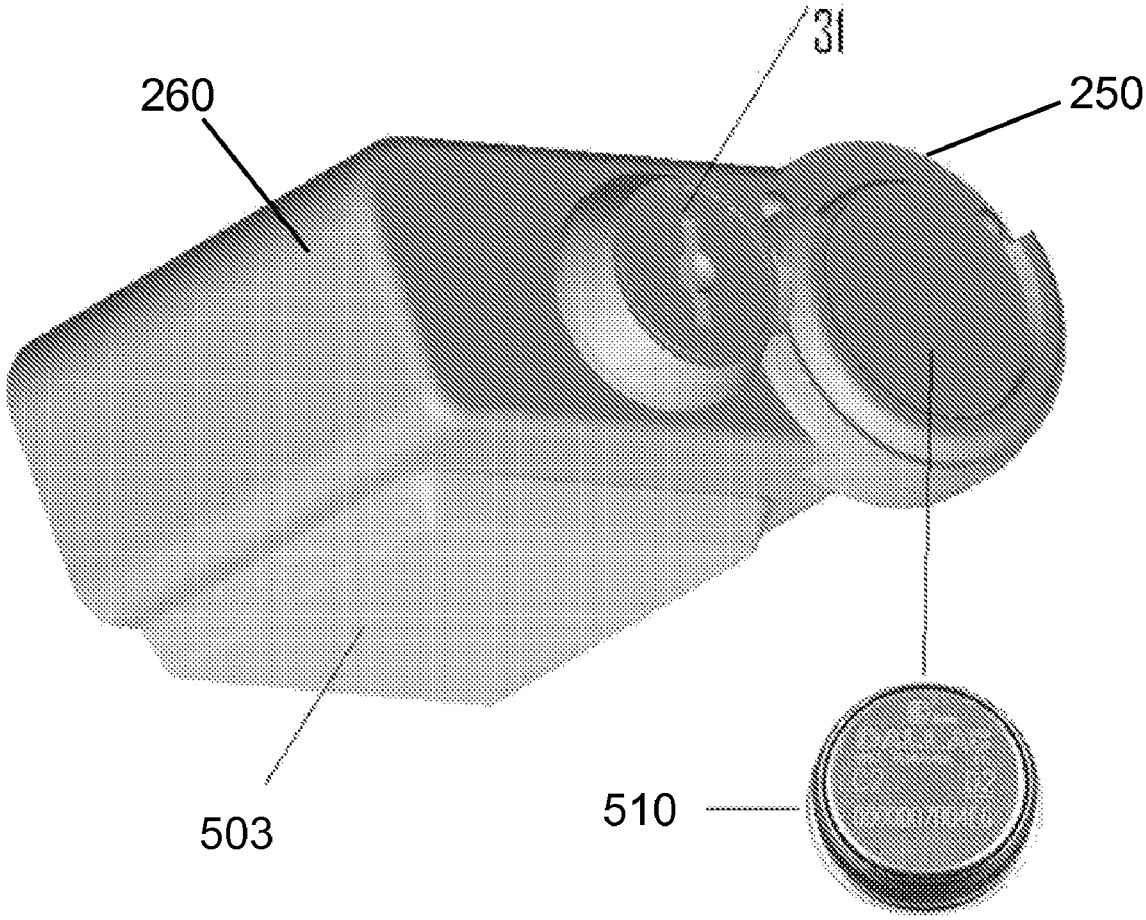

Turning now to FIGS. 5A and 5B there is shown a protracted view of housing 260 in the configuration of the preferred embodiment, where housing 260 is constructed without a separate connector shell (item 220 in the first embodiment). This embodiment is shown with the embedded microchip housing 250 for microchip 510. Note that screw 501 is inserted into locking cam 34 to secure to mini cam lock 31. The locking fulcrum clamp 502 is attached to the bottom of protective plate 503 by inserting the slotted spring clip 504 through a hole 505 on one side of the bottom protective plate 503. The hole 505 goes through the protective plate 503, allowing one end of spring clip 504 to be seated in well 513, which for security reasons does not go all the way through to the outside wall (not shown) of protective plate 503. Two protracted clips 506 protrude through two holes 507 in housing 260 to secure the protective plate 503 to the housing 260.

Figure 6A:
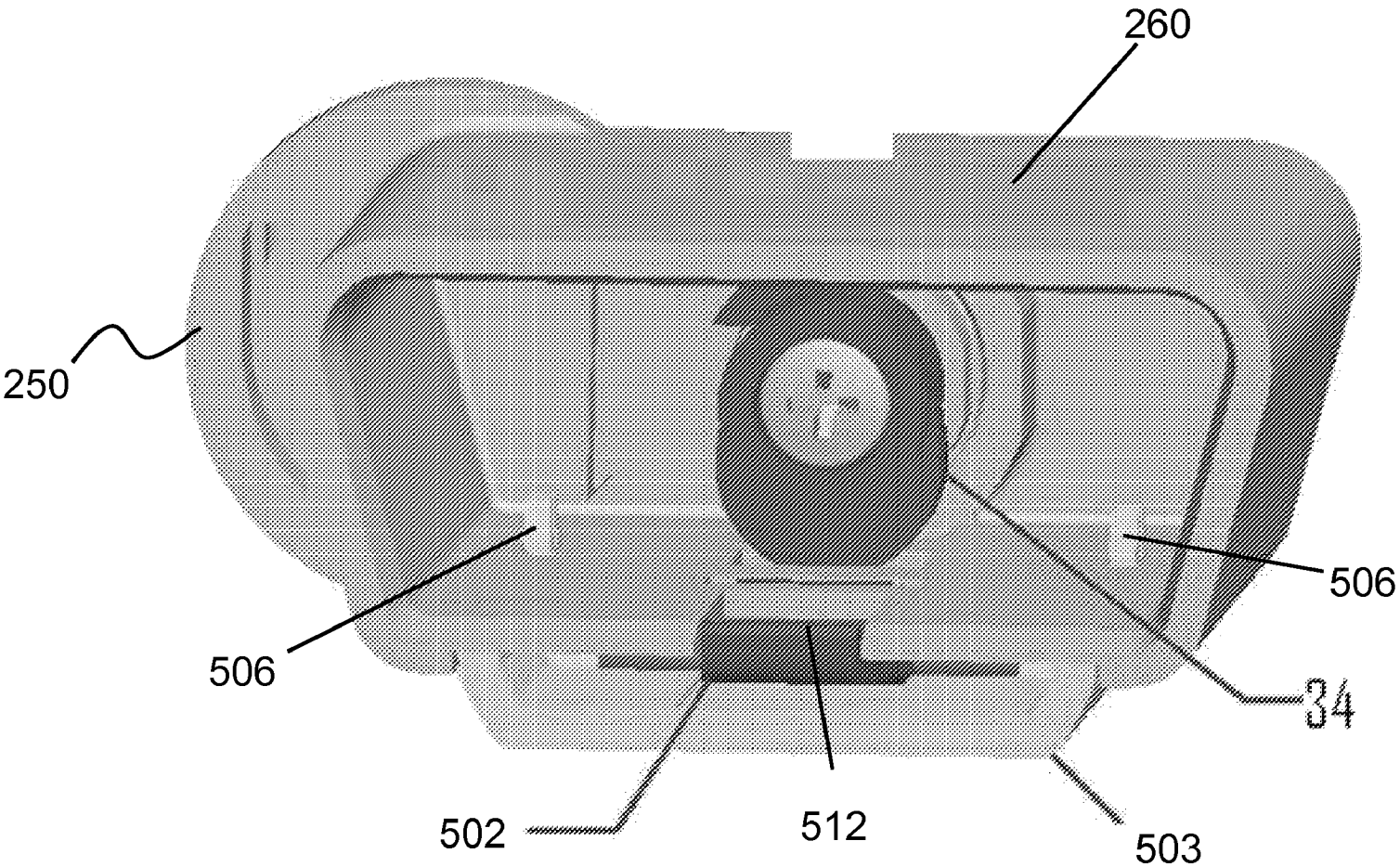
FIGS. 6A and 6B show an interior view of the vehicle connector lockout apparatus in the locked and unlocked mode in a preferred embodiment having the embedded microchip.
Figure 6B:
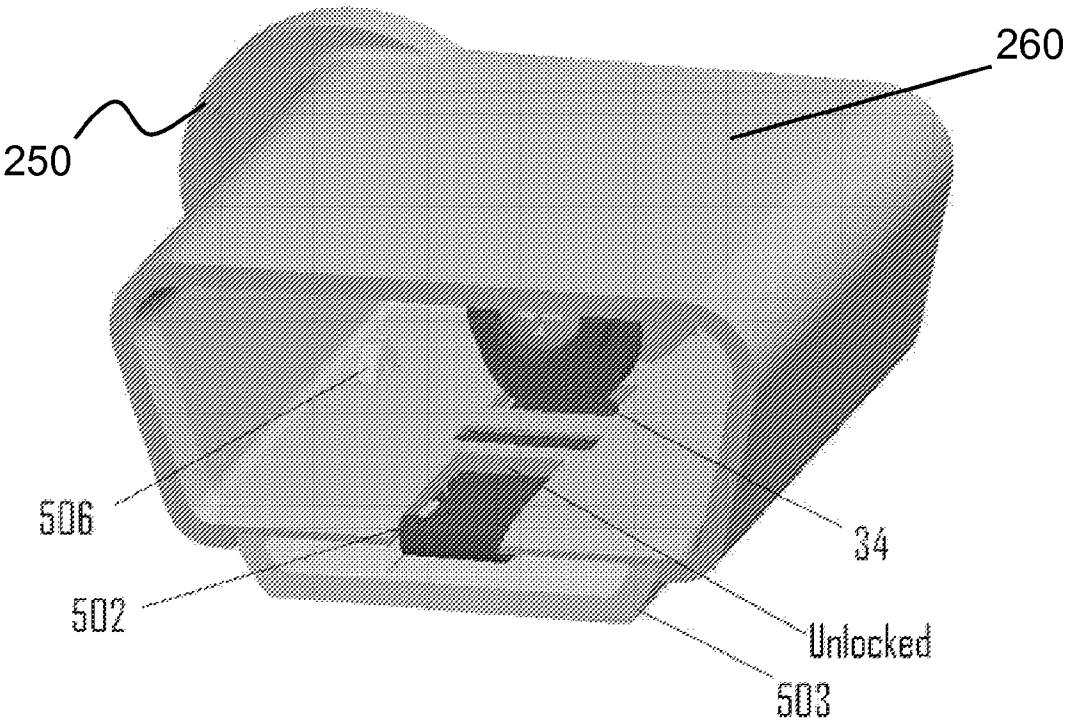

Furthermore, FIG. 5A shows the two open spaces 508 and 509 in housing 260 into which fit locking fulcrum clamp 502, with raised pad 511 fitting into space 509. FIG. 5B shows a front view of housing 260 with the mini cam lock 31 and the microchip 510 in microchip housing 250. FIGS. 6A and 6B show an interior view of the vehicle connector lockout apparatus in the locked and unlocked mode, where the connector is locked when locking cam 34 is rotated so as to depress pad 511 in space 509 (as shown in FIG. 6A), thereby locking clamp lip 512 against protrusion 12, and unlocked when locking cam 34 is rotated so as to relieve pressure on pad 511 and thereby release clamp lip 512 (as shown in FIG. 6B).

Figure 7:
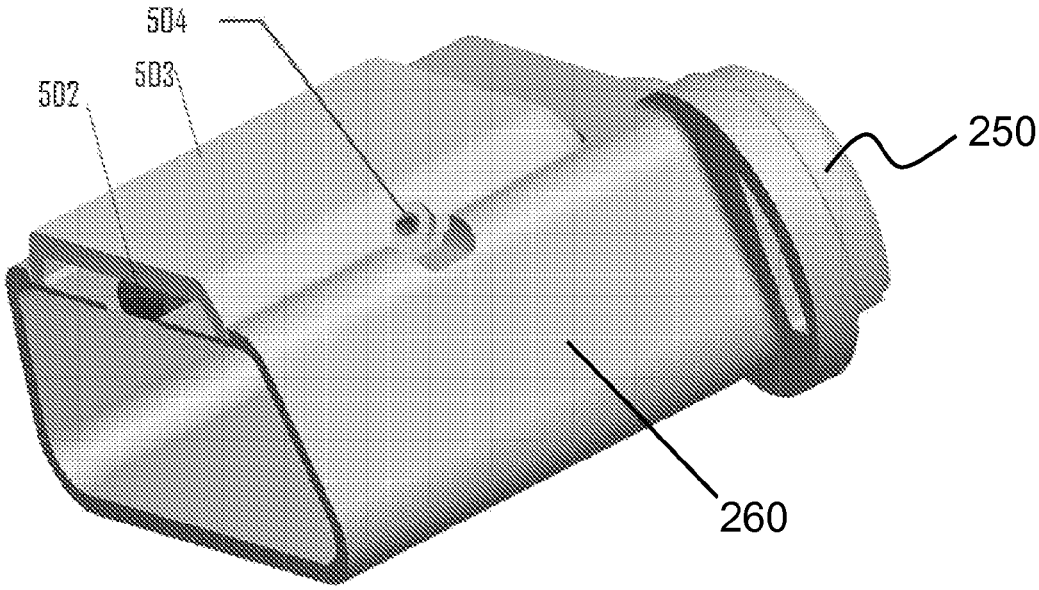
FIG. 7 shows the bottom outside and side view of the connector lockout apparatus in a preferred embodiment having the embedded microchip.

Now turning to FIG. 7 there is shown a bottom outside and side view of the connector lockout apparatus in a preferred embodiment having the embedded microchip. Note one end of spring clip 504 shown at the hole (item 505 in FIG. 5A) on the side of protective cover 503. Also note that fulcrum clamp 502 is shown and there appears an opening in the protective cover 503 extending to either side of the fulcrum clamp 502. However, for additional security and in order to prevent tampering with the device via this opening, in practice this opening is eliminated by having a further sidewall (not shown in FIG. 7 or in FIGS. 5A, 6A and 6B) on the protective cover 503, leaving only an opening large enough to accommodate protrusion 12.

The primary function of the microchip 510 will now be described. A secondary objective of the invention is to provide rapid and accurate delivery of secure roadside medical information closer to the point and time of incident—during emergency roadside medical care at the scene. The standardized location of the diagnostic link connector provides a common point of reference for securing roadside medical information. One embodiment of the invention calls for a microchip application to store via the lockout device (i.e. the blocking mating connector) information specific to the individual such as name and address, physical description, digital photograph, current medications, allergies and chronic conditions, recent procedures, special instructions, emergency contacts and insurance. In this preferred implementation of the invention, the blocking mating connector is configured to use data pins on the blocking mating connector for transmission of this information from the microchip application mounted on or within the blocking mating connector.

This vital information is invaluable in life threatening conditions caused by vehicle crashes. Information is entered pre-crash by programming the microchip and inserting it into the interface located on or within the connector lockout apparatus. Post-crash upon arrival of emergency personnel this information is readily available via a PDA or laptop computer.

This secondary aspect of the invention may be implemented using as the microchip 510 an iButton® chip housed in a stainless steel enclosure. The electrical interface is reduced to the absolute minimum, i.e., a single data line plus ground reference. The energy needed for operation is either "stolen" from the data line ("parasitic power") or is taken from an embedded lithium cell. The logical functions range from a simple serial number to password-protected memory, to 64 kbits and beyond of nonvolatile RAM or EPROM, to real time clock plus 4 kbits of nonvolatile RAM. Common to all iButtons® is a globally unique registration number, the serial 1-Wire™ protocol, presence detect, and a communication in discrete time slots.

In this exemplary embodiment, the iButton is embedded within the vehicle connector lockout apparatus case. Alternatively it may be located on top of the case or otherwise attached to the case. An iButton is a computer chip housed in a stainless steel can that is manufactured by Dallas Semiconductor Corporation mainly for applications in harsh and demanding environments. An iButton is a microchip similar to those used in a smart card but housed in a round stainless steel button of 17.35 mm×3.1 mm-5.89 mm in size (depending on the function). Like a smart card, an iButton does not have an internal power source. It requires connection to a reader (known as a Blue Dot Receptor) in order to be supplied with power and to receive input and send output.

As implemented in this invention, the vehicle connector lockout apparatus is located in a standardized and regulated location in motor vehicles, thus providing a common reference point to secure a memory storage device for post-crash emergency response access. Pre-crash, iButton is programmed to include an identification number assigned to the connector lockout apparatus. Within the vehicle, in this location, the iButton is used to store information regarding a particular vehicle and the owner/operator. This can involve one or more of the following: the Vehicle Identification Number (VIN), timestamp, registration, ownership, insurance information, medical information, the vehicle operators physician, next of kin contact information and other emergency contact information, the patient's medical plan, the patient's allergies and other medical information.

Other information can be stored in iButton as required by the owner/user of the vehicle. An iButton may also contain its own processor, in addition to a memory, wherein the information stored includes an identification number assigned to the connector apparatus, and wherein that identification number is usable to obtain a vehicle identification number for said vehicle when the connector lockout apparatus iButton is plugged into a computer device via a USB reader or otherwise wireless interface that is capable of accessing the internet. The iButton is one example of a memory storage device that can be used in the present invention.

In one example, a connector lockout apparatus utilizes an electro-magnetic application. In this embodiment the vehicle 12 v DC power is used to signal an embedded electro-magnetic mechanism to release the male connector and thus permit the diagnostic port to be used when vehicle power is in "Accessory-Switch" mode. Subsequently, when vehicle power is "OFF" (either by turn-key or crash) then the electromagnetic mechanism is active and thus prevents use of the diagnostic port.

Other examples of applicable locking mechanisms include a flat key and tubular mechanism; or cam or radial key; or lockout sub-variants of either; or a special tool or seal; or electronic key and lock mechanism and codes to prevent access to the data, or means to physically secure lockout apparatus to connector via a hasp to which a lock can be attached by way of a seal, blank flange, or bolted slip designed with any other integral part of the connector through which a lock can be affixed or a locking mechanism built into it to lock and unlock lockout apparatus; and a method to remove the lockout apparatus from the connector.

Motor vehicles such as automobiles and light duty trucks (less than 8,500 lbs GVW) are complex machines with thousands of mechanical and electrical parts. Each are required to perform a vast array of tasks and operations such as polluting less and providing more efficient fuel economy. Consumer demand for luxury items such as electric windows, door locks, navigation systems, entertainment systems, and the like, have caused vehicles to become substantially more electronically complex with each model year since 1970. Government regulations for safety and security features such as ant-theft devices and air bags have contributed to increased automotive electronic systems such as sensing diagnostic modules to determine if deployment was successful. As motor vehicles become more electronically complex the need to diagnose malfunctions and to repair them greatly increased.

The pins of the vehicle diagnostic port are numbered as follows:

1—Discretionary;
2—SAE-J1850 (VPW/PWM) positive bus line;
3—Discretionary (airbag| . . . );
4—Chassis ground (battery negative);
5—Signal ground (max 1.5 Amp);
6—ISO-15765-4 CAN_high line;
7—K-line of ISO-9141-2 and ISO-14230-4 (data line);
8—Discretionary (Code| . . . );
9—Discretionary;
10—SAE-J1850 (PWM) negative bus line;
11—Discretionary (alarm|remote| . . . );
12—Discretionary;
13—Discretionary;
14—ISO-15765-4 CAN_low line;
15—L-line of ISO-9141-2 and ISO-14230-4 (init only);
16—Positive voltage (battery positive, max 4 Amp).

"Discretionary" means that the car manufacturer can use the pin for whatever they require, so if it's equipped, it's a "proprietary" pin.

Figure 1A:
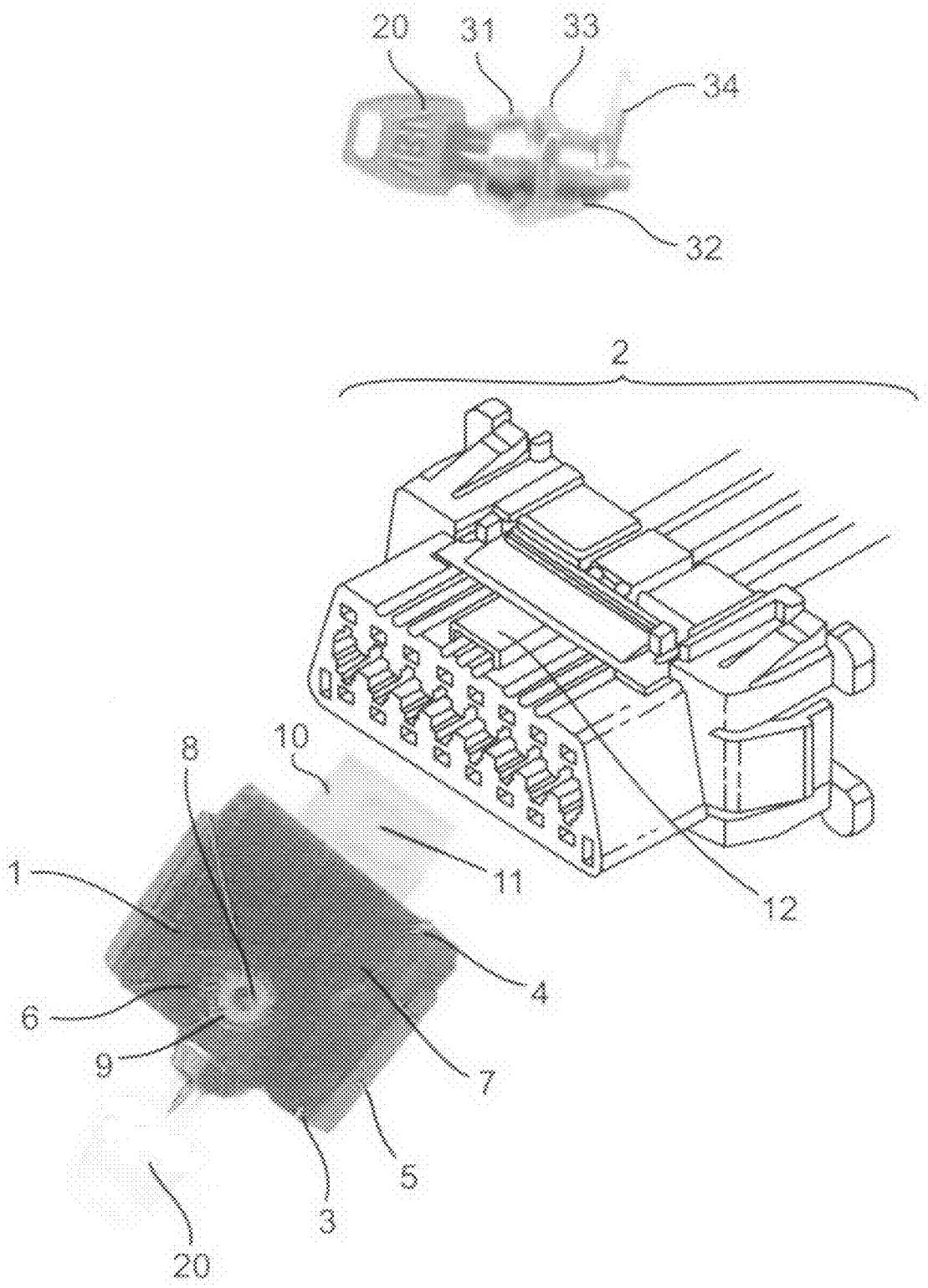
FIG. 1A is a perspective view showing the invention's lockout device in relation to the diagnostic port connector of the vehicle.
Figure 1B:
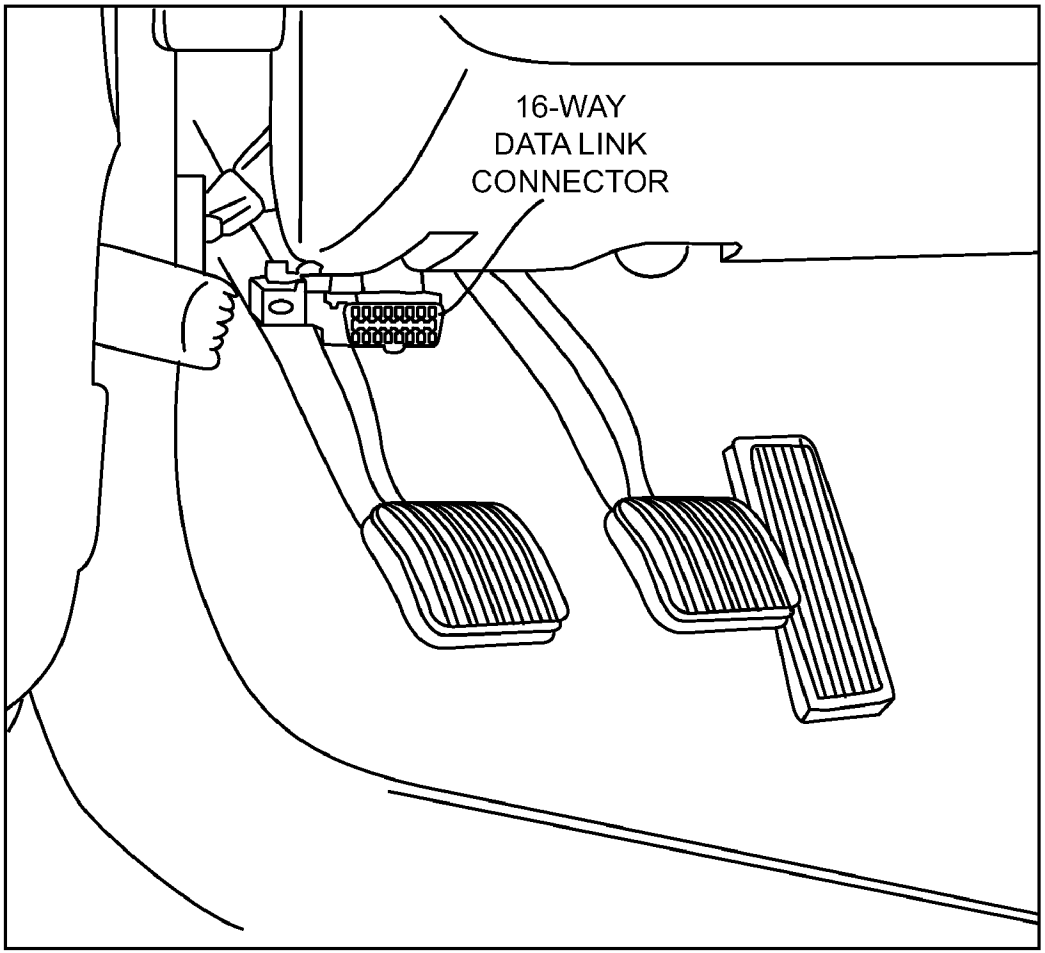
FIGS. 1B and 1C are schematic diagrams showing typical location of the diagnostic port connector within the vehicle.
Figure 1B:
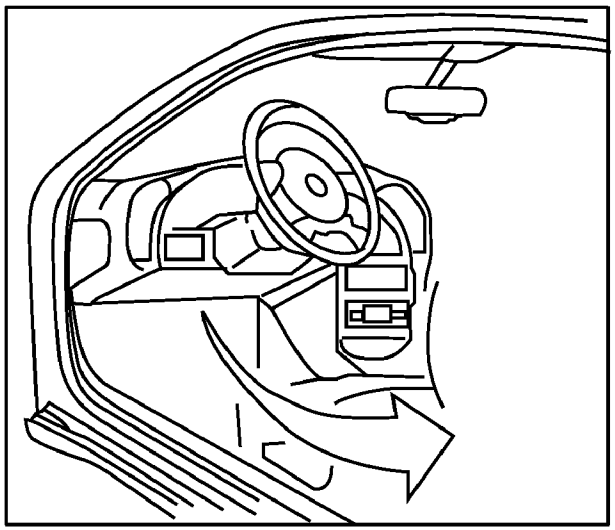
Figure 1C:
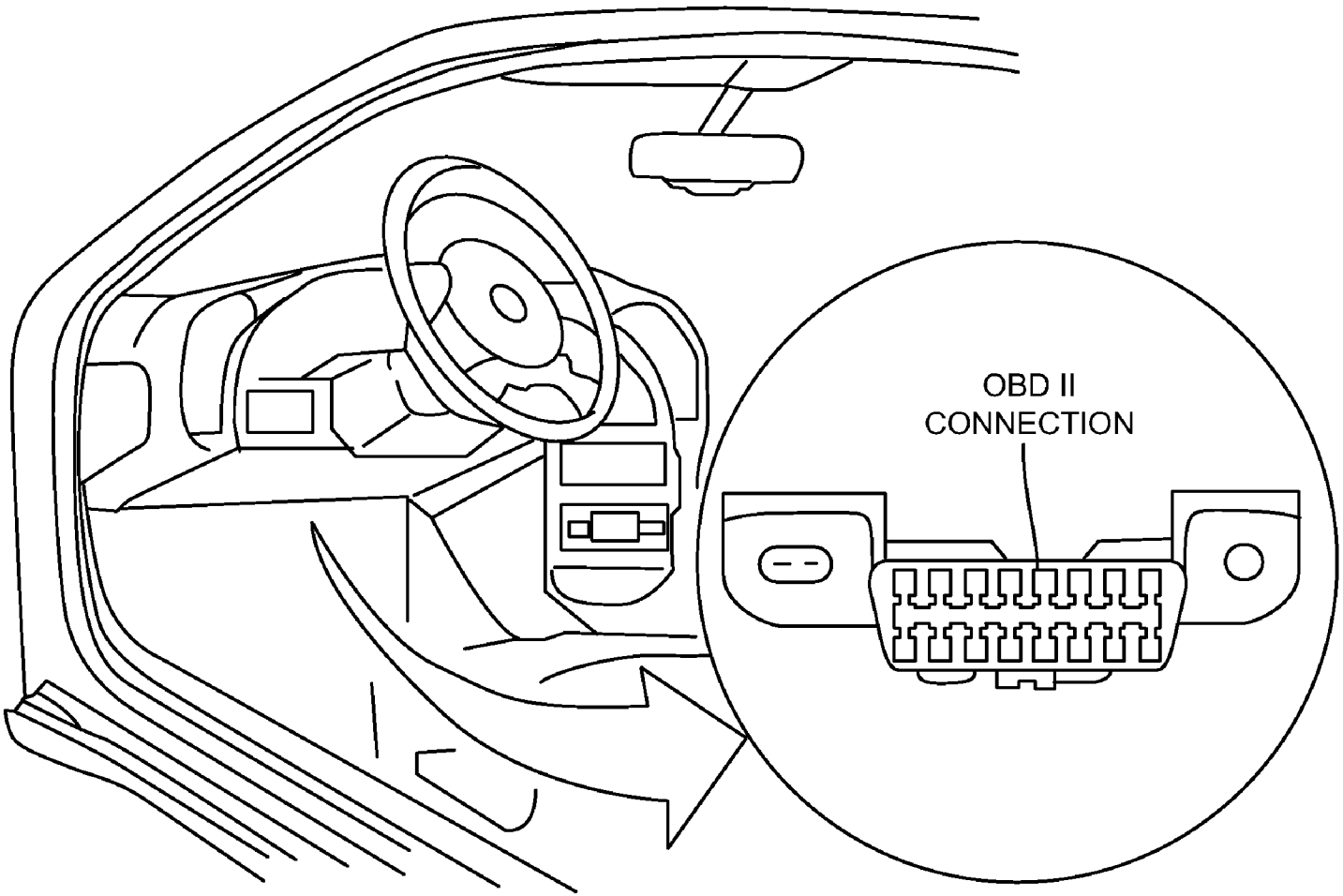

FIG. 1 is a block diagram illustrating a connector lockout apparatus 102 application for a function 103 or device 104 in accordance with an aspect of the present invention. The view presented in FIG. 1 is described at a high level to facilitate a broad understanding of the present invention and its context. The system 100 facilitates restricting, hampering and blocking interested parties from obtaining and utilizing motor vehicle event data recorder information by preventing vehicle information tools 105 to be used with motor vehicle event data recorder systems. The system 100 can operate in accordance with a number of motor vehicle standards including, but not limited to 1) on board diagnostics (OBD), 2) on board diagnostics II (OBD II), 3) enhanced on board diagnostics II (enhanced OBD II), 4) OEM specific on board diagnostics, 5) OEM motor vehicle event data recorder IEEE standards, 6) SAE VEDI recommended practices for functions and devices and 7) various automotive aftermarket motor vehicle event data recorder functions and devices. The system 100 includes a diagnostic link connector port 106, and a vehicle connector lockout apparatus 102.

The system 100 is operable to permit users to obtain vehicle information and perform functions including, but not limited to, updating calibration settings, altering drive axle ratio, viewing diagnostic data, re-flashing modules and/or control units of the vehicle diagnostic system, location of tire pressure monitor sensors, tuning the engine and similar maintenance, monitoring, and diagnostic functions. However, most important, the system also provides a means to control access to motor vehicle event data recorder data by securing the vehicle connector lockout apparatus 102 to the diagnostic link connector 106.

The vehicle information tool 105, such as a scan tool, a code reader, an engine analyzer, a hand held diagnostic tester, a PDA and the like, includes a controller, circuitry, and an interface that allow transmission of and reception of diagnostic requests and information. However, it is appreciated that the vehicle information tool can be comprised of other components instead of or in addition to the above mentioned components. The vehicle information tool 105 is operable to communicate via one or more diagnostic protocols (e.g., VPWM, PWM, ISO, K2K, and CAN). The set of protocols known to the vehicle information tool 105 is referred to as the tool protocol(s). Additionally, the vehicle information tool 105 typically, but not necessarily, includes a display and an input device (e.g., keypad), and can also include other components such as an audio output device (e.g., speaker), a printing device, and the like.

The vehicle information system 107, in this aspect, includes a number of control units such as an engine control unit, a transmission control unit, a brake control unit, and a speed control unit. The vehicle information system 107 is also operable to communicate via one or more diagnostic protocols. Typically, an OBD and/or OBD-II connector 106 is present to facilitate communication with the vehicle information system 107. However, it is appreciated that other types of connections 108 and/or connectors 109 including wired and wireless are contemplated and within the scope of the present invention. The set of protocols known to or usable by the vehicle information system 107 is referred to as the vehicle protocol(s). However, the diagnostic protocol(s) employed by the vehicle information system 107 can be unknown or unused by the vehicle information tool 105. As a result, direct communication between the vehicle information system 107 and the vehicle information tool 105 via a common protocol 106 may not be possible.

The number of control units present within the vehicle information system 107 can individually employ different protocols. As an example, an engine control unit 109 could employ a first protocol (e.g., ISO or CANH 110 while a brake control unit 111 employs a second protocol, e.g., CANL 112. As a result, communication with the vehicle information system 107 can employ and/or require different protocols depending upon the control unit being accessed. As an example, communication with the vehicle information system 107 related to the engine control unit 109 is preferable in the first protocol whereas communication with the vehicle information system 107 related to the brake control unit 111 in the second protocol, is preferable. Thus, the preferable protocol employed for a communication link with the vehicle information system can vary depending on the target control unit. Communication mediums, including wired cables, wireless networks, cellular networks, Bluetooth, WiFi, and the like can be employed to communicate between the vehicle information tool 105 and the vehicle information system 107.

In lieu of the connector lockout apparatus and serial port connectors discussed above, other connector types can be used with the present invention, with the type of port and connector chosen being determined largely by compatibility concerns. Advances in automotive electronics may create new connectors that this invention will cover.

Vehicle information systems 107 (e.g., motor vehicle event data recorders, on board diagnostic systems, ABS, and the like) are systems associated with vehicles that perform vehicle related functions including control, monitoring, data collection, fault detection, and the like. Typically, vehicle information systems 107 are physically located on vehicles. Vehicle information tools 105 (e.g., scan tools, code readers, engine analyzers, hand held diagnostic testers, PDA's and the like) communicate and/or interact with vehicle information systems 107 in order to obtain collected data, obtain identified faults, alter operating parameters of the vehicle, obtain data in real time, and the like.

Motor vehicle's event data recorders 113 and diagnostic control systems include one or more electronic vehicle controller units (ECU) 114 located within motor vehicles. The control units can include various systems and/or subsystems within the motor vehicle 129. For example, a control unit can control an engine, a transmission, a brake or a steering mechanism. These control units are generally connected to a number of sensors and/or actuators 115. The vehicle control units 116 include an interface 106 to permit external communication with other electronic devices via one or more communication protocols. Some examples of control units present in motor vehicle information systems include an engine control unit 109, a transmission control unit 111, a brake control unit 116, and a speed control unit 117.

A typical engine control unit 109 can receive a number of signals from a number of sensors 118, including but not limited to, coolant temperature sensor, an oxygen sensor, an intake manifold pressure sensor, an air-conditioner switch, a vehicle speed sensor, an accelerator switch, a throttle position sensor, a neutral switch, and an engine speed sensor. The engine control unit receives the above signals and can generate a number of output control signals in response to control engine components. Some examples of components that can be controlled by the generated control signals include a canister purge solenoid, an exhaust gas recirculation (EGR) system actuator, an idling control actuator, an ignition coil, and/or a plurality of fuel injectors.

A typical transmission control unit 111 also receives a plurality of input signals from various sensors 119. The transmission control unit outputs various control signals in response to these input signals. These control signals can control various automatic transmission actuators and thereby control an automatic transmission. A brake control unit 116 receives a plurality of input signals from a brake switch and/or a plurality of wheel speed sensors 120. In response to these input signals, the brake control unit can produce various control signals that control brake actuators of an anti-lock braking system.

A typical speed control unit 117 receives input signals from a speed set switch and a vehicle speed sensor 115. In response to these input signals, the speed control unit adjusts a throttle actuator to run the motor vehicle at an approximately constant speed. The speed control unit can also receive input signals from a brake switch, an accelerator switch, a neutral switch, a deceleration switch and/or a resume switch. In response, the speed control unit can discontinue constant speed control or reset a constant speed after changing the speed of the motor vehicle. Thus, as described supra, a typical motor vehicle utilizes multiple control units for controlling the operation of the motor vehicle.

One function performed by a motor vehicle control system involves the monitoring of motor vehicle emissions. The Federal Clean Air Act of 1990 required that all cars and light trucks sold in the United States after Jan. 1, 1996, adhere to the California Air Resources Board (CARB) requirements. A primary objective of the CARB requirements was the implementation of a system, within a motor vehicle, to monitor the electronic engine management and emission control systems of the motor vehicle. This system was to alert a driver, in the early stages, of an emission control component or system failure and provide vehicle information about the failure. In response to the CARB requirements, on-board diagnostics (OBD) II was implemented [106]. The Society of Automotive Engineers (SAE) has set forth numerous standards that are applicable to OBD II 106 equipped motor vehicles. For example, SAE J2012 sets forth the common diagnostic trouble codes (DTCs) and SAE J2190 defines the common diagnostic test modes (DTMs).

Currently, an OBD II compliant vehicle can include one or more of five communication protocols; SAE J1850 variable pulse width modulation (VPWM), SAE J1850 pulse width modulation (PWM), ISO 9141-2 (ISO), ISO 14230-4 (K2K), and ISO 15765-4 (CAN). Many General Motors (GM) cars and light trucks implement the J1850 VPWM communication protocol. A large number of current Chrysler, European and Asian Import vehicles implement the ISO 9141-2 communication protocol. A number of current Ford vehicles implement the J1850 PWM communication protocol.

Control units within motor vehicle's diagnostic control systems monitor sensors for faults and/or fault conditions and log faults that occur to a system memory. Typically, a malfunction indicator lamp (MIL) is also lit to inform a driver of the motor vehicle that a problem exists. Subsequently, a service technician can attempt to trouble-shoot an indicated fault by connecting a vehicle information tool, such as a scan tool, a code reader, an engine analyzer, a hand held diagnostic tester, and the like to a diagnostic link connector of the motor vehicle information system.

Returning to FIG. 1, a typical vehicle information tool 105 includes a microcontroller 121 and interface circuitry 122 to convert the electronic signals supplied by a control unit in the motor vehicle to a signal/protocol that is readily useable by the microcontroller 121 of the vehicle information tool 105. The vehicle information tool 105 can also include other features including, but not limited to, adjusting module configuration settings, flash reprogramming, data access, and the like. Generally, vehicle information tools 105 initiate requests that are sent to motor vehicle information systems 107, which then generate responses that are provided back to the vehicle information tools 105.

As an example, some vehicle information tools do not employ or properly employ all of the protocols included in the OBD II [106] standard. Some vehicle diagnostic control systems [106] employ protocols not included by these vehicle information tools. As a result, some vehicle information tools [105] are unable to properly communicate with some vehicle diagnostic control systems.

Historically, motor vehicles have evolved from mechanical to electro-mechanical vehicles and crash data recording technology in light-duty vehicles has developed and evolved based on differing technical needs of manufacturers and their customers without industry standards or government regulation until the introduction of air bag technologies. With air bags came a need to standardize the wide variations existing among vehicle manufacturers regarding the scope and extent of recorded data. Various standard setting organizations such as the Institute of Electronics and Electrical Engineers (IEEE) and the Society of Automotive Engineers (SAE) developed standards (IEEE 1616) and recommended practices (SAE 1698, 1698-1 and 1698-2) to standardize the recording of specific data elements, specify minimum data elements and parameters that various manufacturers are currently recording, as well as those elements reasonably predicted to be recorded in the foreseeable future, and to establish a common format for display and presentation of that data so recorded.

As noted above, vehicle event recording is a fairly new automotive feature for which there is a variety of applicable uses and implementation strategies in existence. Therefore, it is reasonable to assume that the current nascent state of the technology precludes competent assessment of available options necessary to identify optimal solutions to control the data. Given the still-questionable consumer acceptance and social accountability of on-board data recording devices, this invention is timely and of practical value. It offers an option for the millions of vehicle owners and operators who are concerned about the legal ramifications of the emerging technology.

Vehicular event data recording and extraction has several potential uses. These include diagnostic and operational information of the on-board occupant protection system, crash reconstruction, and improved highway safety. A standard format for the vehicle event data output will help facilitate these uses, and possibly more, by improving the availability and efficient use of the extracted data. Collection of various types of data for a variety of commercial and non-commercial uses is of significant interest of many entities. As previously stated, the use of event data recorders may serve the public interest, namely, the use of data to enhance the knowledge of those tasked with designing vehicles and roadways and with shaping traffic safety policy. However, public acceptance demands consumer protection.

A vehicle's electronics system 107 can transmit, receive, record and/or stores any necessary data and information as designed by the vehicle manufacturer.

Data related to some events are exchanged on the vehicle electric bus system (110, 112) as part of this normal vehicle on-board data communication and those event-related data may be stored in several electronic controller units (ECUs, e.g. 109. In understanding the value and significance of the vehicle connector lockout apparatus 102 it is important to view event data recording is a number of different ways. First, as a functionality to report event-related data 109 and not as a single device 113 or aftermarket, unlike the aviation data recorder often called as "Black Box." However, in some applications of the invention the vehicle connector lockout apparatus 102 falls well within the definition of event data 128 within this perimeter, especially in regards to automotive aftermarket recording devices 123.

Event data may be extracted from ECUs 109 using a data extraction tool 105 which may use proprietary communication protocols and interfaces or which may be common across several vehicle lines. Therefore, event data is the data which may be stored in some ECUs 109 in some formats and can be extracted by some tools 105. Thus, to summarize, event data recorder (EDR) is a functionality of storing event-related data 128 using existing vehicle electronics systems and capabilities. Event-related data may be stored in one electronic controller unit (ECU) 109 or in several ECUs (109, 111, 114, and 116) depending on the vehicle electronics architecture. On the other hand, there may be a dedicated device (module box) 113 to execute this functionality, and this device 113 regardless of nomenclature (e.g. Sensing Diagnostic Module (SDM) or Restraint Control Module (RCM) may be termed "black box" by the general public).

Regarding the actual data extracted following a crash there are various data extraction tools 105 (hardware) and software to copy or extract event data from ECUs 109. One example is the Vetronix Crash Data Retrieval System. This system became available to the public in 2000. The Vetronix CDR system is available for public purchase for approximately $2500 per unit. Other systems may be a manufacturer-specific tool or a common tool across various vehicle models. The main functionalities of a data extraction tool 124 are 1) establish a communication link with the vehicle electronics system, which may be through a J1962 diagnostics connector 106 or another data port, or directly from a specific ECU 113 without connecting to the vehicle bus system (110, 112), 2) make a copy of event data from ECUs, and/or 3) convert the event data 128 into the another format.

The data conversion to the "other" format can be executed outside of the data extraction tool 105 when a proper conversion tool is provided to generate the "other" event data. An "event" may be generated as the output of a data extraction tool 105 or accident database.

An event record usually consists of high-frequency, low-frequency and static data sets. Generally, definitions for three different types of impact events are provided: frontal 125, side 126 and rollover 127. Distinction among those three impact events is made solely by the event data from the vehicle electronics system 107 and not from the results of accident reconstruction efforts. When frontal delta-V or acceleration exceeds pre-determined threshold, this event is considered as a frontal impact event. The same rule is applied to side and rollover impact events. In general, these words, "frontal," "side," and "rollover," should correspond to the initial direction of impact however they do not necessary represent the manner of the collision or physical configurations of vehicles during an accident. Each event has a beginning and end and the time lapse between those two time points is called duration of an event.

The beginning and end of each type of impact events are defined mathematically from the change in impact data (acceleration or velocity change). Whenever a beginning of an event is recorded, in this series of documents, output data from the vehicle electronics system should be considered that it contains at least one impact event. Beginning of an event should not be interpreted as the time when a vehicle collides to another object, and end of an event should not be interpreted as the time when the vehicle comes to a complete stop. The tables below illustrate exemplary data elements that can be protected with the present invention.

Types of Event Data Recorder Data

There are three types of event data recorder data secured by this invention. 1) High-frequency data have 100 Hz sampling rate (10 millisecond intervals) or higher, 2) Low-frequency data have 1 Hz sampling rate (1 second intervals) or higher and 3) Static data that are recorded only once per event and are therefore not associated with temporal resolution.

The following tables list the data elements that are specified for the vehicle diagnostic port that is the subject of this invention. The length of data elements in this recommended practice varies from 1 bit to 252 bytes.

Required Essential Data Elements

| | Data Element Name | # of Sample | Bytes per Sample | Total Bytes |
|---|---|---|---|---|
| 1 | Delta-V, Longitudinal | 26 | 1 | 26 |
| 2 | Maximum delta-V, Longitudinal | 1 | 1 | 1 |
| 3 | Time, Maximum delta-V, Longitudinal | 1 | 1 | 1 |
| 4 | Speed, vehicle indicated | 11 | 1 | 11 |
| 5 | Engine throttle, % full | 11 | 1 | 11 |
| 6 | Service brake, on/off | 11 | 1 | 11 |
| 7 | Ignition cycle, crash | 1 | 2 | 2 |
| 8 | Ignition cycle, download | 1 | 2 | 2 |
| 9 | Safety belt status, driver | 1 | 1 | 1 |
| 10 | Frontal air bag warning lamp | 1 | 1 | 1 |
| 11 | Frontal air bag deployment time, Driver (1st, multi) | 1 | 1 | 1 |
| 12 | Frontal air bag deployment time, RFP (1st, multi) | 1 | 1 | 1 |
| 13 | Multi-event, number of events | 1 | 1 | 1 |
| 14 | Time from event 1 to 2 | 1 | 1 | 1 |
| 15 | Complete file recorded | 1 | 1 | 1 |
| | Total | | | 72 |
| | Total for 2 Events | | | 144 |
| | With Redundancy (=Total for 2 events × 3) | | | 432 |

Required Additional Data Elements

| | Data Element Name | # of Sample | Bytes per Sample | Total Bytes |
|---|---|---|---|---|
| 1 | Lateral acceleration | 126 | 2 | 252 |
| 2 | Longitudinal acceleration | 126 | 2 | 252 |
| 3 | Normal acceleration | 126 | 2 | 252 |
| 4 | Delta-V, Lateral | 26 | 1 | 26 |
| 5 | Maximum delta-V, Lateral | 1 | 1 | 1 |
| 6 | Time, maximum delta-V, Lateral | 1 | 1 | 1 |
| 7 | Time, maximum delta-V, Resultant | 1 | 1 | 1 |
| 8 | Engine RPM | 11 | 1 | 11 |
| 9 | Vehicle roll angle | 11 | 1 | 11 |
| 10 | ABS activity | 11 | 1 | 11 |
| 11 | Stability control | 11 | 1 | 11 |
| 12 | Steering wheel angle | 11 | 1 | 11 |
| 13 | Safety belt status, RFP | 1 | 1 | 1 |
| 14 | Frontal air bag suppression switch status, RFP | 1 | 1 | 1 |
| 15 | Frontal air bag deployment, time to $N^{th}$ stage, Driver[1] | 1 | 1 | 1 |
| 16 | Frontal air bag deployment, time to $N^{th}$ stage, RFP[1] | 1 | 1 | 1 |
| 17 | Frontal air bag deployment, $N^{th}$ stage disposal, Driver[1] | 1 | 1 | 1 |
| 18 | Frontal air bag deployment, $N^{th}$ stage disposal, RFP[1] | 1 | 1 | 1 |
| 19 | Side air bag deployment time, Driver | 1 | 1 | 1 |
| 20 | Side air bag deployment time, RFP | 1 | 1 | 1 |
| 21 | Curtain/tube air bag deployment time, Driver | 1 | 1 | 1 |
| 22 | Curtain/tube air bag deployment time, RFP | 1 | 1 | 1 |
| 23 | Pretension deployment time, Driver | 1 | 1 | 1 |
| 24 | Pretension deployment time, RFP | 1 | 1 | 1 |
| 25 | Seat position, Driver | 1 | 1 | 1 |
| 26 | Seat position, RFP | 1 | 1 | 1 |
| 27 | Occupant size classification, Driver | 1 | 1 | 1 |
| 28 | Occupant size classification, | 1 | 1 | 1 |
| 29 | Occupant position classification, Driver | 1 | 1 | 1 |
| 30 | Occupant position classification, RFP | 1 | 1 | 1 |
| | Total | | | 857 |
| | Total for 2 Events | | | 1,714 |
| | With Redundancy (=Total for 2 events × 3) | | | 5,142 |

The connector lockout apparatus as described has numerous advantages. The connector lockout apparatus easily locks and prevents use of diagnostic link connector port and is easily unlocked and removed. When the connector lockout apparatus locks the diagnostic link connector port, the diagnostic link connector port cannot be used to extract crash data elements and other information from the vehicle. A mechanical or electro-mechanical opening device or mechanism can be used to remove the connector lockout apparatus and unlock the diagnostic link connector port. Security of the crash data then comprises simply controlling access to the opening device.

Even though numerous characteristics and advantages of the present invention together with details of the structure and features of the invention have been set forth in the foregoing description, the disclosure is illustrative only. Changes may be made in the details, especially in matters of shape, size, and arrangement of parts within the principles of the invention to the full extent indicated by the broad general meaning of the terms in which the appended claims are expressed.

While the invention has been described in terms of a single preferred embodiment, those skilled in the art will recognize that the invention can be practiced with modification within the spirit and scope of the appended claims.

Having thus described my invention, what I claim as new and desire to secure be Letters Patent is as follows:

1. A vehicle connector lockout apparatus, comprising:

means for attaching a blocking mating connector to a vehicle diagnostic port connector, there being a direction of movement for effecting a connection of the mating connector to the vehicle diagnostic port connector, said vehicle diagnostic port connector having a raised protrusion extending from a casing of the diagnostic port in a direction perpendicular to said direction of movement of the mating connector;

means for locking said blocking mating connector to said vehicle diagnostic port connector by a pressure mechanism for clamping the blocking mating connector to said protrusion so as to prevent disconnection of the mating connector from the vehicle diagnostic port connector; and means for unlocking said blocking mating connector from said vehicle diagnostic port connector by releasing said pressure mechanism.

2. The vehicle connector lockout apparatus of claim 1, wherein said attaching means comprises a connector shell adapted to mate to said diagnostic port connector while leaving exposed a portion of the protrusion from said diagnostic port connector, said exposed portion thereby being accessible for positioning by the pressure mechanism of a locking portion of the mating connector over the protrusion so that the locking portion is clamped to the protrusion, and wherein said locking means further comprises means for clamping said adapted connector shell to said protrusion and means for disabling said unlocking means.

3. The vehicle connector lockout apparatus of claim 2, wherein said clamping means further comprises:

a lock assembly mounted within a housing, said housing being attachable to said connector shell, a locking portion mounted within said housing and extending over said attached connector shell and over said protrusion when said connector shell is connected to said diagnostic port connector, wherein said lock assembly operates to press said locking portion over said protrusion upon operation of said lock assembly, said housing and attached connector shell thereby being clamped to said protrusion by the pressure applied by operation of said lock assembly to said locking portion against said protrusion.

4. The vehicle connector lockout apparatus of claim 3, wherein said lock assembly contains a keyed opening and is operable by turning a key inserted into said keyed opening.

5. The vehicle connector lockout apparatus of claim 3, wherein said lock assembly is operable by receiving a coded signal.

6. The vehicle connector lockout apparatus of claim 4, wherein said lock assembly further comprises a cylinder behind said keyed opening, a cam being supported by said cylinder and positioned such that turning said key forces said cam against a first portion of said locking clamp so as to press a second portion of said locking clamp against said protrusion.

7. The vehicle connector lockout apparatus of claim 6, wherein said locking clamp has a raised button on said first portion, said locking clamp being aligned within said housing so that button protrudes through a hole in said housing, and wherein said unlocking means further comprises insertion of said key into said keyed opening, turning said key so as to release the pressure applied by said cam, and pressing said button to lift said second portion of said locking clamp from contact with said protrusion.

8. The vehicle connector lockout apparatus of claim 3, further comprising a microchip memory component attached to said blocking mating connector for storage of information applicable to providing services to an operator of said vehicle.

9. The vehicle connector lockout apparatus of claim 8, wherein the information stored includes one or more of: timestamp, vehicle ownership, vehicle identification number (VIN), insurance, personal medical data, and health care provider information.

10. The vehicle connector lockout apparatus of claim 8, wherein the information stored includes an identification number assigned to the connector lockout apparatus, and wherein that identification number is usable to obtain a vehicle identification number for said vehicle when the connector lockout apparatus is plugged into a computer device that is capable of accessing the Internet.

11. A vehicle connector lockout apparatus for protecting vehicle owner interests, comprising:

means for blocking access to a vehicle diagnostic port connector, said blocking means further comprising, means for attaching a blocking mating connector to a vehicle diagnostic port connector, there being a direction of movement for effecting a connection of the mating connector to the vehicle diagnostic port connector, said vehicle diagnostic port connector having a raised protrusion extending from a casing of the diagnostic port in a direction perpendicular to said direction of movement of the mating connector;

means for locking said blocking mating connector to said vehicle diagnostic port connector by a pressure mechanism for clamping the blocking mating connector to said protrusion so as to prevent disconnection of the mating connector from the vehicle diagnostic port connector; and means for unlocking said blocking mating connector from said vehicle diagnostic port connector by releasing said pressure mechanism; and means attached to said blocking means for enabling access by responders at the scene of a crash of the vehicle to information about the vehicle owner.

12. The vehicle connector lockout apparatus of claim 11, wherein said attaching means comprises a connector shell adapted to mate to said diagnostic port connector while leaving exposed a portion of a protrusion from said diagnostic port connector, said exposed portion thereby being accessible for positioning by the pressure mechanism of a locking portion of the mating connector over the protrusion so that the locking portion is clamped to the protrusion, and wherein said locking means further comprises means for clamping said adapted connector shell to said protrusion and means for disabling said unlocking means.

13. The vehicle connector lockout apparatus of claim 12, wherein said clamping means further comprises:

a lock assembly mounted within a housing, said housing being attachable to said connector shell, a locking portion mounted within said housing and extending over said attached connector shell and over said protrusion when said connector shell is connected to said diagnostic port connector, wherein said lock assembly operates to press said locking portion over said protrusion upon operation of said lock assembly, said housing and attached connector shell thereby being clamped to said protrusion by the pressure applied by operation of said lock assembly to said locking portion against said protrusion.

14. The vehicle connector lockout apparatus of claim 13, wherein said lock assembly contains a keyed opening and is operable by turning a key inserted into said keyed opening.

15. The vehicle connector lockout apparatus of claim 13, wherein said lock assembly is operable by receiving a coded signal.

16. The vehicle connector lockout apparatus of claim 14, wherein said lock assembly further comprises a cylinder behind said keyed opening, a cam being supported by said cylinder and positioned such that turning said key forces said cam against a first portion of said locking clamp so as to press a second portion of said locking clamp against said protrusion.

17. The vehicle connector lockout apparatus of claim 16, wherein said locking clamp has a raised button on said first portion, said locking clamp being aligned within said housing so that button protrudes through a hole in said housing, and wherein said unlocking means further comprises insertion of said key into said keyed opening, turning said key so as to release the pressure applied by said cam, and pressing said button to lift said second portion of said locking clamp from contact with said protrusion.

18. The vehicle connector lockout apparatus of claim 13, wherein said enabling means further comprises a microchip memory component attached to said blocking mating connector for storage of information applicable to providing roadside care to an operator of said vehicle.

19. The vehicle connector lockout apparatus of claim 18, wherein the information stored includes one or more of: timestamp, vehicle ownership, vehicle identification number (VIN), insurance, personal medical data, and health care provider information.

20. The vehicle connector lockout apparatus of claim 18, wherein the information stored includes an identification number assigned to the connector lockout apparatus, and wherein that identification number is usable to obtain a vehicle identification number for said vehicle when the connector lockout apparatus is plugged into a computer device that is capable of accessing the Internet.

* * * * *